US010226129B2

(12) United States Patent
Christianson et al.

(10) Patent No.: US 10,226,129 B2
(45) Date of Patent: Mar. 12, 2019

(54) ERGONOMIC SEATING ASSEMBLIES AND METHODS

(71) Applicant: Cramer LLC, Kansas City, MO (US)

(72) Inventors: Nicholas M. Christianson, Fairway, KS (US); Jean Francois Gomrée, Golden Valley, MN (US); Rodney C. Schoenfelder, Shakopee, MN (US); Jeffrey Weber, Golden Valley, MN (US); Shawn Monitor, Robbinsdale, MN (US)

(73) Assignee: Cramer LLC, Kansas City, MO (US)

( * ) Notice: Subject to any disclaimer, the term of this patent is extended or adjusted under 35 U.S.C. 154(b) by 0 days.

(21) Appl. No.: 15/261,543

(22) Filed: Sep. 9, 2016

(65) Prior Publication Data

US 2017/0065087 A1 Mar. 9, 2017

Related U.S. Application Data

(63) Continuation of application No. 14/235,847, filed as application No. PCT/US2012/049599 on Aug. 3, 2012, now Pat. No. 9,498,066.

(Continued)

(51) Int. Cl.
*A47C 7/44* (2006.01)
*A47C 7/02* (2006.01)

(Continued)

(52) U.S. Cl.
CPC ..... *A47C 7/445* (2013.01); *A47C 1/023* (2013.01); *A47C 1/026* (2013.01); *A47C 1/03* (2013.01);

(Continued)

(58) Field of Classification Search
CPC ..... A47C 7/445; A47C 7/46; A47C 7/022; A47C 7/004; A47C 3/026
See application file for complete search history.

(56) References Cited

U.S. PATENT DOCUMENTS 2,529,683 A * 11/1950 Fox ..... A47C 7/443 297/291
2,818,911 A 1/1958 Syak (Continued)

FOREIGN PATENT DOCUMENTS

CN 201658054 U 12/2010
EP 0434897 A1 7/1991

(Continued)

OTHER PUBLICATIONS

US 9,474,378, 10/2016, Christianson et al. (withdrawn)

(Continued)

*Primary Examiner* — Patrick J Maestri
(74) *Attorney, Agent, or Firm* — Schwegman Lundberg & Woessner, P.A.

(57) ABSTRACT

Seating assemblies and methods are disclosed. A seating assembly can comprise a seat, a back support, and a frame component. The frame component can extend from a bottom portion, positioned near an underside of the seat, to a top portion, configured to maintain the back support at a position above the seat. The back support can laterally extend from a left edge portion to a right edge portion and can include a spring member at or near each of the left and right edge portions. The spring member can include at least one undulation or are providing integrated compression adaptation to a user. The seating assembly can further comprise a tilt mechanism, engaged with the frame component, including (Continued)

one or more leaf springs and a spring contact assembly. The spring contact assembly can be positioned on a top side of the one or more leaf springs.

26 Claims, 21 Drawing Sheets

Related U.S. Application Data

(60) Provisional application No. 61/515,138, filed on Aug. 4, 2011.

(51) Int. Cl.

| | |
|---|---|
| ***A47C 1/023*** | (2006.01) |
| ***A47C 3/026*** | (2006.01) |
| ***A47C 7/00*** | (2006.01) |
| ***A47C 7/50*** | (2006.01) |
| ***A47C 7/54*** | (2006.01) |
| ***A47C 1/026*** | (2006.01) |
| ***A47C 1/03*** | (2006.01) |
| ***A47C 3/20*** | (2006.01) |
| ***A47C 7/46*** | (2006.01) |
| ***A47C 7/52*** | (2006.01) |

(52) U.S. Cl.

CPC ..... *A47C 3/026* (2013.01); *A47C 3/20* (2013.01); *A47C 7/004* (2013.01); *A47C 7/006* (2013.01); *A47C 7/024* (2013.01); *A47C 7/029* (2018.08); *A47C 7/46* (2013.01); *A47C 7/50* (2013.01); *A47C 7/52* (2013.01); *A47C 7/543* (2013.01)

(56) References Cited

U.S. PATENT DOCUMENTS

| | | | | |
|---|---|---|---|---|
| 3,429,612 | A | 2/1969 | Cobb et al. | |
| 3,669,496 | A | 6/1972 | Chisholm | |
| 4,300,249 | A | 11/1981 | Taylor | |
| 4,715,654 | A | 12/1987 | Laskowitz | |
| 5,011,227 | A | 4/1991 | van Hekken et al. | |
| 5,039,167 | A | 8/1991 | Sweet | |
| 5,152,581 | A | 10/1992 | Norsworthy | |
| 5,195,801 | A | 3/1993 | Franck et al. | |
| 5,295,728 | A | 3/1994 | Schaevitz | |
| 5,374,102 | A | 12/1994 | Archambault et al. | |
| 5,558,398 | A * | 9/1996 | Santos | A47C 4/54 297/284.3 |
| 5,585,608 | A | 12/1996 | Kraemer | |
| 5,857,739 | A | 1/1999 | Smith | |
| 5,887,951 | A | 3/1999 | Willingham | |
| 5,951,105 | A | 9/1999 | Slettebo | |
| 5,988,754 | A | 11/1999 | Lamart et al. | |
| 6,022,071 | A | 2/2000 | Smith | |
| 6,036,268 | A | 3/2000 | Larson | |
| 6,082,824 | A * | 7/2000 | Chow | A47C 7/022 297/452.22 |
| 6,135,562 | A | 10/2000 | Infanti | |
| 6,196,631 | B1 | 3/2001 | Larson | |
| 6,554,364 | B1 | 4/2003 | Dammermann et al. | |
| 6,609,755 | B2 * | 8/2003 | Koepke | A47C 1/03255 297/300.1 |
| 6,616,232 | B2 | 9/2003 | Herman et al. | |
| 6,619,748 | B1 | 9/2003 | Tseng | |
| 6,685,267 | B1 | 2/2004 | Johnson et al. | |
| 6,761,406 | B2 * | 7/2004 | Kinoshita | A47C 3/12 297/296 |
| 6,811,218 | B2 | 11/2004 | Deimen et al. | |
| 6,945,602 | B2 | 9/2005 | Fookes et al. | |
| 7,213,886 | B2 | 5/2007 | Schmitz et al. | |
| 7,452,034 | B2 | 11/2008 | Jung | |
| 7,513,569 | B2 | 4/2009 | Curiger | |
| 7,566,097 | B2 | 7/2009 | Sander et al. | |
| 7,614,697 | B1 | 11/2009 | Lai | |
| 7,654,617 | B2 | 2/2010 | Farnworth et al. | |
| 7,922,248 | B2 | 4/2011 | Aldrich et al. | |
| 7,931,257 | B2 | 4/2011 | VanDeRiet et al. | |
| 7,971,935 | B2 | 7/2011 | Saez et al. | |
| 8,262,162 | B2 | 9/2012 | Castro, Jr. et al. | |
| 8,613,481 | B2 | 12/2013 | Parker et al. | |
| 8,752,896 | B2 | 6/2014 | Takeuchi et al. | |
| 8,833,856 | B2 | 9/2014 | Uhlenbrock | |
| 9,498,066 | B2 | 11/2016 | Christianson et al. | |
| 2003/0052520 | A1 | 3/2003 | Erne | |
| 2004/0195881 | A1 | 10/2004 | Wells | |
| 2005/0035638 | A1 | 2/2005 | Pennington et al. | |
| 2005/0253441 | A1 | 11/2005 | Benden et al. | |
| 2006/0244294 | A1 | 11/2006 | Dozsa-Farkas | |
| 2008/0238165 | A1 | 10/2008 | Freestone et al. | |
| 2012/0007400 | A1 | 1/2012 | Behar et al. | |
| 2012/0013161 | A1 | 1/2012 | Adams et al. | |
| 2014/0125102 | A1 | 5/2014 | Mcmillen et al. | |
| 2014/0239686 | A1 | 8/2014 | Christianson et al. | |

FOREIGN PATENT DOCUMENTS

| | | | |
|---|---|---|---|
| EP | 2739183 | | 10/2017 |
| FR | 1383559 | A | 12/1967 |
| GB | 2361636 | A | 12/1964 |
| WO | WO-02102199 | A1 | 12/2002 |
| WO | WO-2013020088 | A2 | 2/2013 |
| WO | WO-2013020088 | A3 | 2/2013 |

OTHER PUBLICATIONS

"U.S. Appl. No. 14/235,847, Corrected Notice of Allowance dated Oct. 21, 2016", 2 pgs.
"U.S. Appl. No. 14/235,847, Examiner Interview Summary dated May 13, 2016", 3 pgs.
"U.S. Appl. No. 14/235,847, Examiner Interview Summary dated Dec. 21, 2015", 3 pgs.
"U.S. Appl. No. 14/235,847, Final Office Action dated Mar. 2, 2016", 16 pgs.
"U.S. Appl. No. 14/235,847, Non Final Office Action dated Aug. 12, 2015", 12 pgs.
"U.S. Appl. No. 14/235,847, Notice of Allowance dated Jun. 9, 2016", 7 pgs.
"U.S. Appl. No. 14/235,847, Response filed Jan. 12, 2016 to Non Final Office Action dated Aug. 12, 2015", 12 pgs.
"U.S. Appl. No. 14/235,847, Response filed May 11, 2016 to Final Office Action dated Mar. 2, 2016", 18 pgs.
"European Application Serial No. 12745983.2, Communication Pursuant to Article 94(3) EPC dated Nov. 25, 2015", 4 pgs.
"European Application Serial No. 12745983.2, Communication pursuant to Rules 161(1) and 162 EPC dated Mar. 18, 2014", 2 pgs.
"European Application Serial No. 12745983.2, Examination Notification Art. 94(3) dated Mar. 27, 2015", 3 pgs.
"European Application Serial No. 12745983.2, Response filed Jul. 20, 2015 to Examination Notification Art. 94(3) dated Mar. 27, 2015", 9 pgs.
"European Application Serial No. 12745983.2, Response filed Sep. 29, 2014 to Communication pursuant to Rules 161(1) and 162 EPC dated Mar. 18, 2014", 26 pgs.
"European Application Serial No. 12745983.2, Summons to Attend Oral Proceedings dated Sep. 14, 2016", 3 pgs.
"European Application Serial No. 12745983.2, Written submission filed Nov. 14, 2016", 17 pgs.
"European Application Serial No. 12745983.2,Response filed Mar. 29, 2016 to Communication Pursuant to Article 94(3) EPC dated Nov. 25, 2015", 12 pgs.
"International Application Serial No. PCT/US2012/049599, International Preliminary Report on Patentability dated Feb. 13, 2014", 12 pgs.
"International Application Serial No. PCT/US2012/049599, International Search Report dated May 6, 2013", 7 pgs.

(56) References Cited

OTHER PUBLICATIONS

"International Application Serial No. PCT/US2012/049599, Invitation to Pay Additional Fees and Partial Search Report dated Jan. 16, 2013", 25 pgs.
International Application Serial No. PCT/US2012/049599, Written Opinion dated May 6, 2013, 10 pgs.
Keegan, Paul, "Behold, the New Throne of the Techie", Fortune, (Oct. 13, 2008), 62, 64.

* cited by examiner

ERGONOMIC SEATING ASSEMBLIES AND METHODS

CLAIM OF PRIORITY

Benefit of priority is hereby claimed to U.S. Provisional Patent Application Ser. No. 61/515,138, entitled "ERGONOMIC SEATING ASSEMBLIES," filed on Aug. 4, 2011, which is hereby incorporated by reference in its entirety.

TECHNICAL FIELD

This patent document pertains generally to seating assemblies and methods. More particularly, but not by way of limitation, this patent document pertains to ergonomic seating assemblies and methods configured to support a user in multiple orientations.

BACKGROUND

In various home, office, educational, and industrial applications, workers and students are required to remain in one location, either sitting or standing, and work on a continuing stream of required tasks. This might occur on a factory assembly line, in a food-processing facility, in a lab, in a classroom, or even performing a clerical function, such as in a mailroom or the like.

For many years, a worker on an assembly line or a student in a lab, for example, has been expected to stand, but sitting in a fixed position is becoming more common. The seats provided to such workers and students, however, are typically institutional seating assemblies, which do not provide proper support or comfort to a user. These institutional seating assemblies typically include a seat and a back support that are rigid and not adjustable relative to each another. As such, the seating assemblies do not adapt to receipt or movement of an occupant user's body. It will be understood from the present disclosure that the ability of a seating assembly to adapt to a user's bodily orientation, at any given time, can be important for the user's comfort and health.

OVERVIEW

The present inventors have recognized, among other things, that a deficiency shared by existing seating assemblies is being designed for a single or limited range of orientations. Existing seating assemblies fail to offer a user with the ability to vary a sitting or leaning orientation to perform different tasks. Different tasks in a workplace, industrial, home, or educational setting require different bodily orientations for maximizing both comfort and task efficiency, and thus, seating assemblies that limit the user to a specific orientation can require the user to perform a given task with improper posture or without adequate lumbar or other support. Restricting the user's movement while sitting, for example, can lead to the user incurring static stress injuries from the inability to reposition his/her body.

The present inventors have further recognized that a user places an enormous amount of stress on his/her spine when situated in a seated orientation. Prolonged sitting in the same orientation can cause fatigue, stiffness, and back pain due to stress and strain on the ligaments and intervertebral disks of the spine, but properly supporting the lumbar curve of the spine can reduce the load on the lower back muscles. Further yet, the present inventors have recognized that a sit/stand or forward-leaning orientation can reduce stresses that normally build-up in the back, specifically the lower back muscles, and legs during prolonged standing.

The present seating assemblies and methods provide innovative features that ergonomically support a user's body at various orientations. A seating assembly cart comprise a seat, a back support, and a frame component. The frame component can extend from a bottom portion, positioned near an underside of the seat, to a top portion, configured to maintain the back support at a position above the seat. The back support can laterally extend from a left edge portion to a right edge portion and can include a spring member at or near each of the left and right edge portions. The spring member can include at least one undulation or arc providing integrated compression adaptation to a user. The seating assembly can further comprise a tilt mechanism, engaged with the frame component, including one or more leaf springs and a spring contact assembly. The spring contact assembly can be positioned on a top side of the one or more leaf springs.

To better illustrate the seating assemblies and methods disclosed herein, a non-limiting list of examples is provided here:

In Example 1, a seating assembly comprises a seat, a back support, and a frame component. The frame component can extend from a bottom portion, positioned near an underside of the seat, to a top portion, positioned near a rearward surface of the back support and configured to maintain the back support at a position above the seat. The back support can laterally extend from a left edge portion to a right edge portion and can include a spring member. The spring member can be coupled at or near each of the left and right edge portions and have at least one undulation or arc, providing integrated compression adaption to a user, adjacent each coupling location. Optionally, the spring member can be coupled at or near a middle portion of the back support and not coupled at the left and right edge portions. By way of example, the spring member can include a closed circle or oval form that is placed between the back support and the top portion of the frame component. Alternatively, the spring member can include an open arc form that is placed between the back support and the top portion of the frame component.

In Example 2, the seating assembly of Example 1 is optionally configured such that compression of the spring member results in a distance between the rearward surface of the back support and the top portion of the frame component being reduced.

In Example 3, the seating assembly of Example 2 is optionally configured such that a maximum distance reduction, between the rearward surface of the back support and the top portion of the frame component, is at least 2 inches.

In Example 4, the seating assembly of any one or any combination of Examples 1-3 optionally further comprises a tilt mechanism, engaged with the frame component, including one or more leaf springs and a spring contact assembly. The spring contact assembly can be positioned on a top side of the one or more leaf springs.

In Example 5, the seating assembly of Example 4 is optionally configured such that the one or more leaf springs include a stacked arrangement of two or more metal leafs, or a composite leaf having a varying stiffness along its length.

In Example 6, the seating assembly of Example 4 is optionally configured such that the tilt mechanism further includes a slide linkage, engaged with a front end portion of the seat, configured to confine upward movement of the front end portion during backward translation of the seat.

In Example 7, the seating assembly of Example 4 optionally further comprises an adjuster mechanism, coupled to the spring contact assembly, configured to adjust a force of the one or more leaf springs acting on the frame component by changing a location of the spring contact assembly along a length of the one or more leaf springs.

In Example 8, the seating assembly of Example 7 is optionally configured such that the adjuster mechanism includes a lever arm engageable with one or more ratchet teeth when the location of the spring contact assembly, along the length of the one or more leaf springs, is selected.

In Example 9, the seating assembly of Example 8 is optionally configured such that the adjuster mechanism includes three guide rollers engaged with a pivoting end, having an arc configuration, of the lever arm.

In Example 10, the seating assembly of any one or any combination of Examples 1-9 is optionally configured such that the seat and the back support each include a plurality of flex voids. The flex voids associated with the seat can include foci positioned at seat locations configured to receive the user's ischial tuberosities bones.

In Example 11, the seating assembly of any one or any combination of Examples 1-10 is optionally configured such that the seat includes at least one seat valley, positioned along or near a centerline of the seat, configured to allow a left edge portion and a right edge portion of the seat to deflect in one or both of a downward direction or a lateral direction.

In Example 12, the seating assembly of any one or any combination of Examples 1-11 optionally further comprises a first tier and a second tier, spaced from the first tier, of foot support platforms or rings.

In Example 13, the seating assembly of Example 12 is optionally configured such that at least one of the first tier or the second tier includes an opening to a support surface positioned underneath a front edge of the seat.

In Example 14, the seating assembly of any one or any combination of Examples 1-13 optionally further comprises an arm rest rotatable in and out of position.

In Example 15, the seating assembly of any one or any combination of Examples 1-14 optionally further comprises a foot support assembly, deployable from a first position to a second position, including a foot support platform and at least one foot support arm configured to support the foot support platform about a curvilinear translation movement between the first and second positions.

In Example 16, a method comprises receiving, at a tilt mechanism, a force adjustment of one or more leaf springs acting on a frame component, including changing a location of a spring contact assembly along a top side of the one or more leaf springs; maintaining a portion of a back support, including a spring member having at least one undulation or arc, in contact with a user at and between a first orientation and a second orientation, including changing a distance between a rearward surface of the back support and a top portion of the frame component supporting the spring member; and translating a seat about the tilt mechanism as the user moves between the first orientation and the second orientation, including creating a pubic arch in a front edge of the seat during a forward-leaning orientation or creating a flattened front seat lip during a backward-leaning orientation.

In Example 17, the method of Example 16 is optionally configured such that receiving the force adjustment includes changing the location of the spring contact assembly along the top side of the one or more leaf springs.

In Example 18, the method of Example 17, optionally configures such that changing the location of the spring contact assembly on the top side of the one or more leaf springs includes changing an orientation of the seat and back support.

In Example 19, the method of any one or any combination of Examples 17 or 18 is optionally configured such that changing the location of the spring contact assembly along the top side of the one or more leaf springs includes receiving a rotating force, at a lever arm engaged with the spring contact assembly, about a virtual pivot point generated by three guide rollers engaged with an arced end of the lever arm.

In Example 20, the method of any one or any combination of Examples 16-19 optionally further comprises rotating a cam-shaped arm rest from a first supporting position to a second supporting, position, including changing an effective supporting position height, relative to the seat, via the rotation.

In Example 21 the method of any one or any combination of Examples 16-20 optionally further comprises receiving, at the frame component, a second seat or a second back support to replace a removed first seat or a removed first back support.

In Example 22, the method of any one or any combination of Examples 16-21 is optionally configured such that maintaining a portion of the back support in contact with the user includes changing the distance between the rearward surface of the back support and the top portion of the frame component at least about one (1) inch, preferably at least about two (2) inches, and more preferably in the range of about three and a half (3.5) inches from an unstressed state.

In Example 23, the method of any one or any combination of Examples 16-22 is optionally configured such that translating the seat about the tilt mechanism includes creating a pubic arch in a front edge of the seat during a forward-leaning orientation or creating a flattened front seat lip during a backward-leaning orientation.

In Example 24, the method of any one or any combination of Examples 16-23 optionally further comprises deploying a foot support assembly synchronized with, and activated by, movement of one or both of the seat or the back support.

In Example 25, a seating assembly comprises a seat, a back support, a frame component configured to maintain the back support at a position above the seat, and a tilt mechanism, engaged with the frame component. The tilt mechanism can include one or more leaf springs and a spring contact assembly positioned on a top side of the leaf springs. The tilt mechanism can further include a slide linkage, engaged with a font end portion of the seat, configured to confine upward movement of the front end portion during backward translation of the seat.

In Example 26, the seating assemblies or methods of any one or any combination of Examples 1-25 is optionally configured such that all elements or options recited are available to use or select from.

Advantageously, the seating assemblies and methods disclosed herein can provide long-term comfort, stability, and support to a user during completion of various active tasks, can be realigned to accommodate different working or seating orientations, and can be conveniently relocated from a first position to a second position on a support surface. These and other examples, advantages, and features of the present seating assemblies and methods will be set forth in part in the following Detailed Description and the accompanying drawings. This Overview is intended to provide non-limiting examples of the present subject matter—it is not intended to provide an exclusive or exhaustive explanation. The Detailed Description and drawings are included to provide further information about the present seating assemblies and methods.

BRIEF DESCRIPTION OF THE DRAWINGS

In the drawings, like numerals can be used to describe similar components throughout the several views. Like numerals having different letter suffixes can be used to represent different instances of similar components. The drawings illustrate generally, by way of example, but not by way of limitation, various embodiments discussed in the present document.

DETAILED DESCRIPTION

The art of seating has grown to a science involving considerations of physiology, material science, and ergonomics. Seated workers or students in home, office, educational, and industrial environments often experience back pain and other physiological difficulties as a result of ergonomic deficiencies of existing seating assembly designs on the market. For example, many users currently sit in a forward leaning posture induced by task demands, yet have to sit in a seating assembly designed to support fully seated or reclining orientations.

It is desirable to provide seating assemblies having a maximum degree of comfort and adjustability since a user oftentimes must occupy a seating assembly for relatively long periods of time and the user must also be able to concentrate on his/her tasks without being distracted by discomfort. While the present seating assemblies and methods can embody multiple features, overall goals include maintenance of good health and comfort to the user. The present seating assemblies and methods provide unique approaches to posture correction using one or more of: a self-adjusting back support including a spring member and/or flex voids, a seat including embedded self-adjusting IT regions, flex voids or a seat valley, a multi-tier foot support platform or ring, a tilt mechanism portion providing synchronization between seal tilt and back support motion and including a spring contact assembly positioned on a top side of one or more leaf springs, a tilt mechanism portion engaged with a front end portion of the seat, synchronization of foot support assembly deployment, a vertically adjustable foot support assembly, a unique base design, and user-friendly actuation interfaces, among other things.

Figure 1:
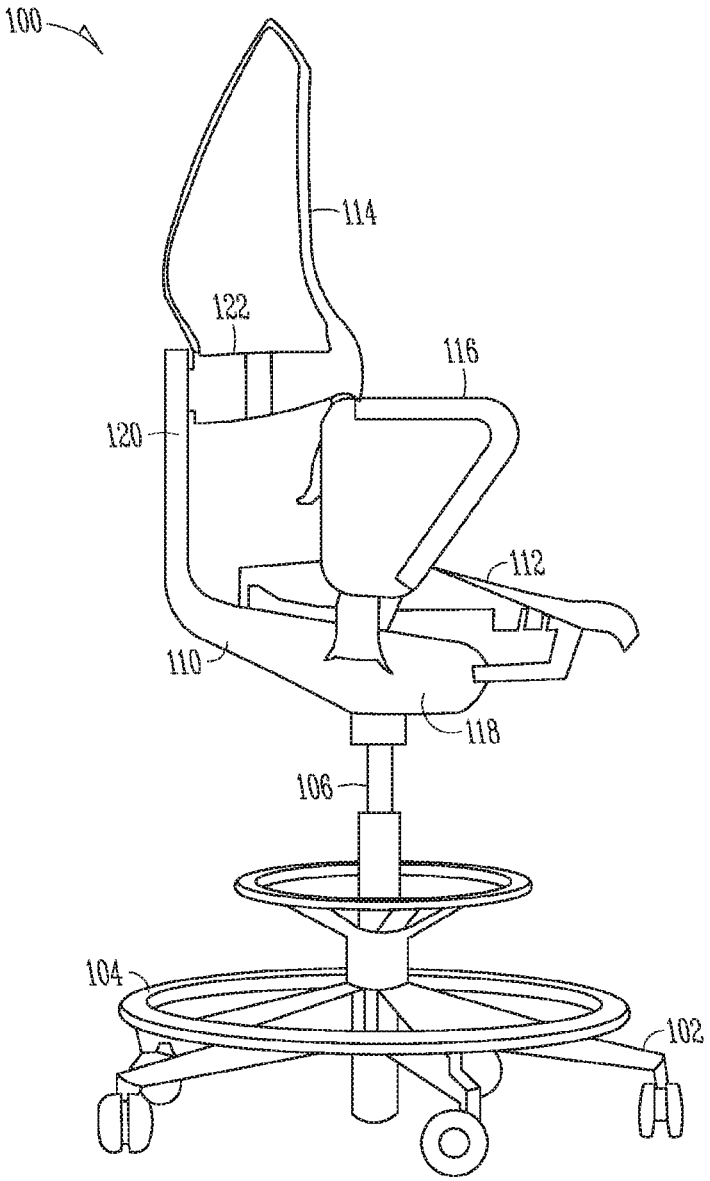
FIG. 1 illustrates an isometric side view of a seating assembly, as constructed in accordance with at least one embodiment.

FIG. 1 illustrates a seating assembly 100 configured to support at least a portion of the weight of a user in forward-leaning, fully sealed, and reclined orientations. The seating assembly 100 can include one or more of a base 102, a foot support 104, a pedestal 106, a tilt mechanism, a frame component 110, a seat 112, a back support 114, and an arm rest 116. The pedestal 106 can vertically extend from a center region of the base 102 and can include a mechanical or pneumatic drive mechanism configured to provide seat 112 elevation adjustments. The pedestal 106 can support the seat 112 and the back support 114 in an elevated position, relative to the base 102, via the tilt mechanism, which can include the tilt mechanism portions shown in FIGS. 4 and 6, for example. The frame component 110 can extend from a bottom portion 118, positioned near an underside of the seat 112, to a top portion 120, positioned near a rearward surface of the back support 114. The top portion 120 can be coupled with a spring member 122 of the back support 114 to maintain the back support 114 at a position above the seat 112.

Figures 2A, 2B, 2C:
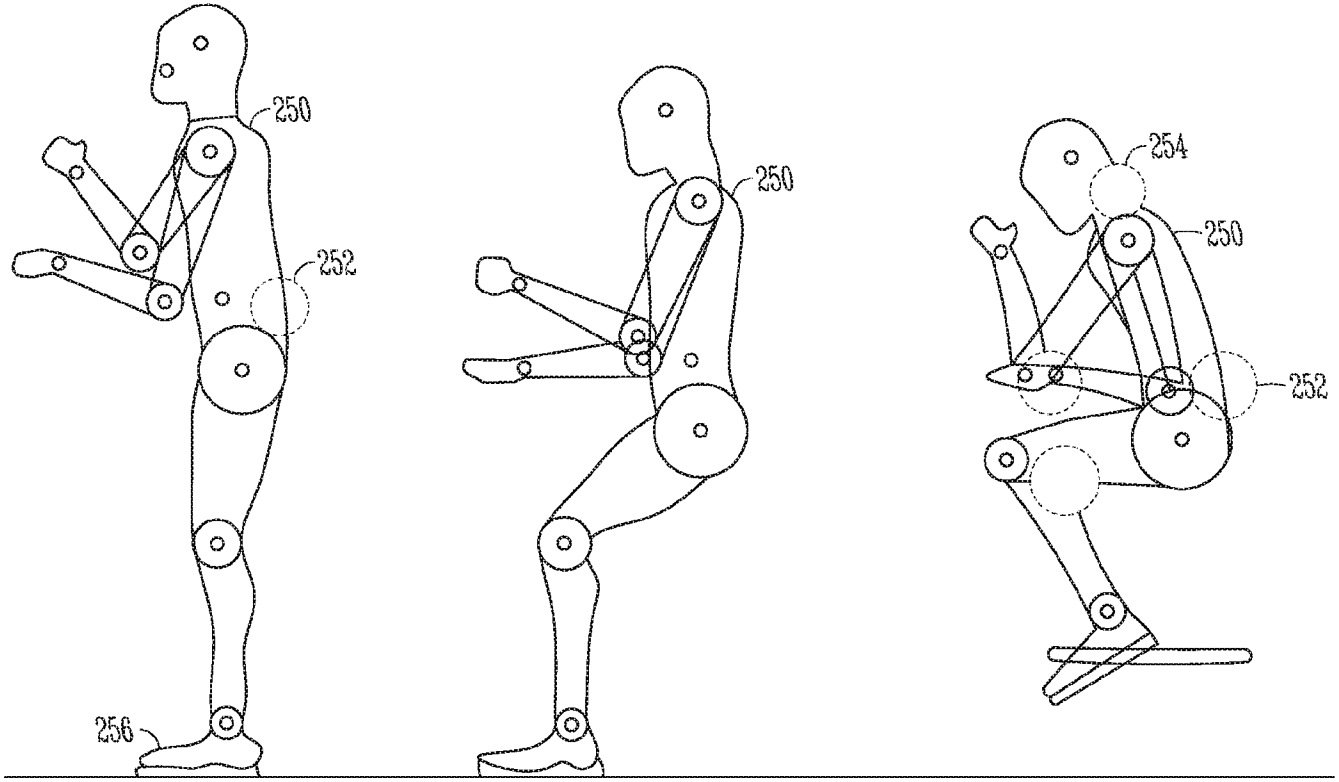
FIGS. 2A-2C illustrate postural analysis of a user at various orientations, including a comparison of postures associated with an existing seating assembly and postures associated with a present seating assembly.

FIGS. 2A-2C illustrate postural analysis of a user 250 at various orientations and resulting from using an existing seating assembly (FIG. 2C) or an example of a present seating assembly (FIG. 2B). Existing seating assemblies, such as the assembly used in FIG. 2C, orientate users in a posture where the user slouches forward when performing a task. The slouched posture can cause the spine 252 of the user to be in a rounded condition, known as kyphosis. A similar rounded condition of the spine 252 can occur when the user stands at a work surface without a seating assembly to perform a task, as shown at FIG. 2A. A sitting or standing posture that causes kyphosis of the spine can be damaging to the back, as the spinal column is displaced from its normal curvature. When the seated or standing user slouches forward, causing the back to be rounded, the discs of the back can be stressed at their forward edges. Additionally, the muscles and other soft tissue adjacent to the spinal column can stretch excessively to accommodate the rounding of the back, and the user's neck 254 can be overextended.

The present seating assemblies, such as au assembly resulting in the orientation of FIG. 2B and the assemblies discussed in further detail below, allow for a user 250 to maintain normal lumbar curvature, known as lordosis, which places little or no strain on the discs of the spinal column or on soft tissue adjacent to the spine. For example, the angle of the user's head can be comfortably inclined due to the forward tilt of a seat or back support. This can relieve tension on the neck 254 of the user and permit the user to be more comfortable and productive, substantially free of back or neck pains caused by existing seating assemblies.

Figure 3A:
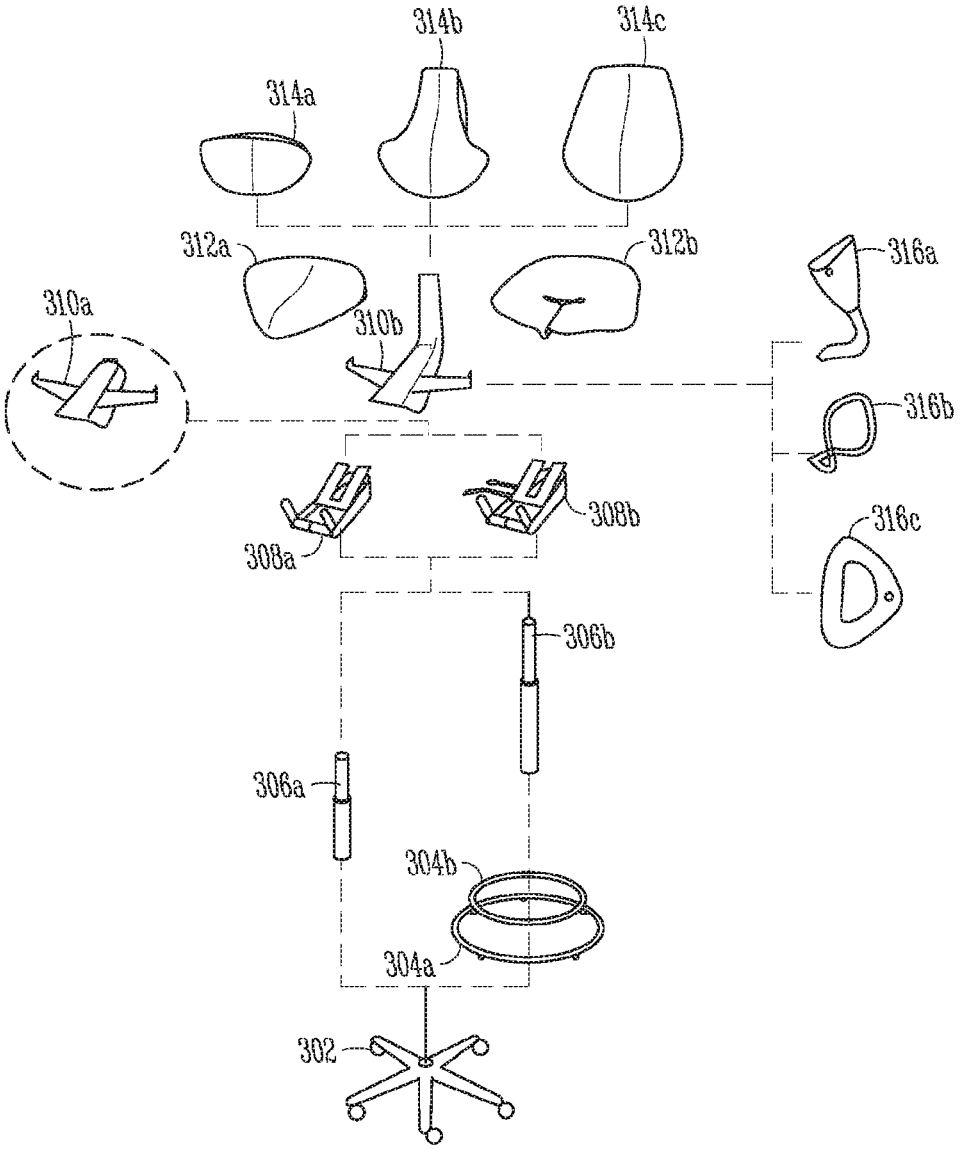
FIG. 3A illustrates a plurality of modular components that can be selected and assembled to form a seating assembly, as constructed in accordance with at least one embodiment.
Figure 3B:
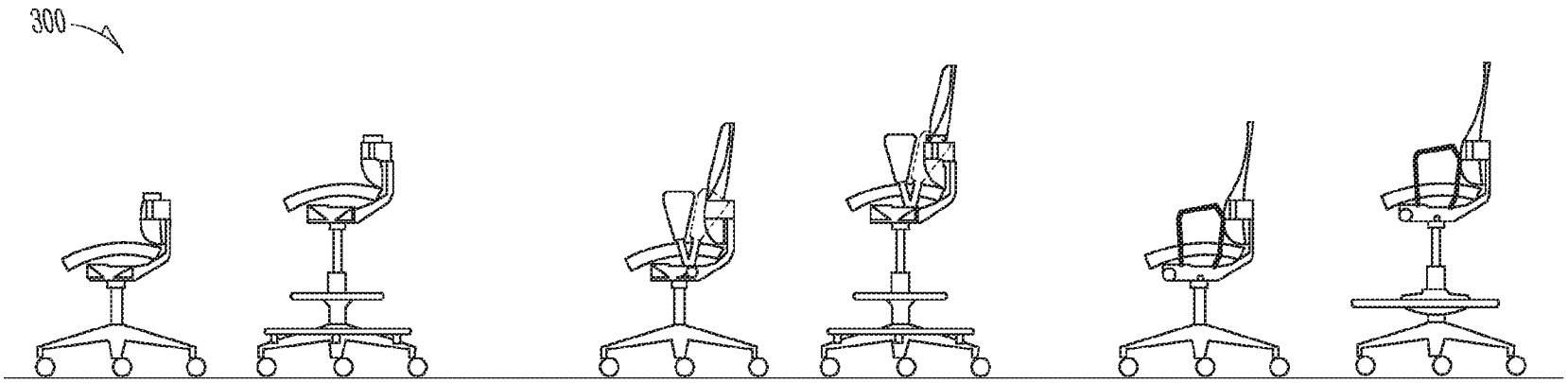
FIG. 3B illustrates a plurality of seating assembly configurations made possible by the assembling of modular components, as constructed in accordance with at least one embodiment.

FIGS. 3A and 3B illustrate a plurality of modular components that, in varying examples, can be selected and assembled to form a desired seating assembly 300 for a particular application. The modular seating assemblies 300 can be useful in a variety of settings, including home, health care, education, music, retail, government, labs, and manufacturing. The modular components can be retrofitted, interchanged, and assembled in a variety of ways to best accommodate a desired use for the seating assembly 300, as shown in FIG. 3B. The seating assembly 300 can include one or more of a base 302, a single tier 304A or two-tier 304B foot support, a low 306A or high 306B pedestal, a passive 308A or adjustable 308B tilt mechanism, a seat only 310A or seat/back 310B frame component, a sit/stand seat 312A or a multi-purpose seat 312B, a low 314A, mid 314B or full 314C back support, and a triangular—316A, pommel—316B, or cam-shaped 316C arm rest. Rotation of the cam-shaped arm rest 316C can change an effective supporting position height, relative to the selected seat, without having to adjust a height mechanism embedded in an upright portion of an arm frame component.

Figure 4:
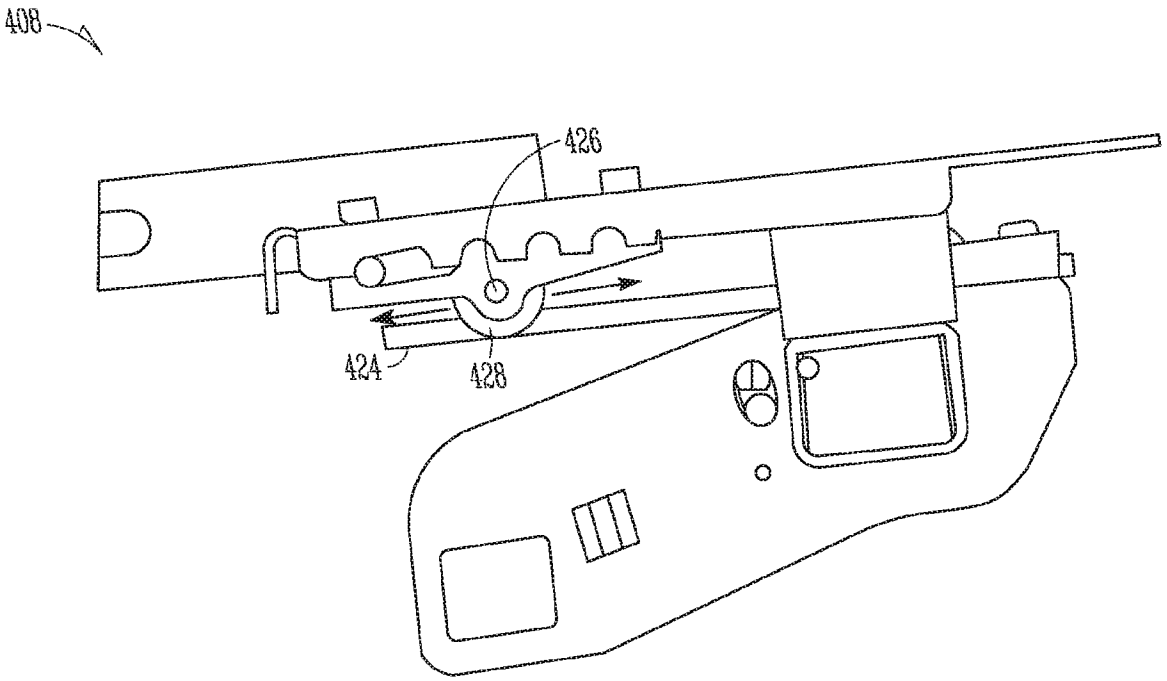
FIG. 4 illustrates a side view of rearward portions of a tilt mechanism for use in a seating assembly, including a leaf spring and a spring contact assembly, as constructed in accordance with at least one embodiment.

FIG. 4 illustrates rearward portions of a tilt mechanism 408 for use in a seating assembly. The rearward portions of the tilt mechanism 408 can be positioned at a top portion of a pedestal and can be engaged with a frame component, which can in turn connect a seat and a back support to one another. The tilt mechanism 408 can be designed to support users all the way to and from sit/stand or forward-leaning, fully seated, and reclined orientations. By way of example, the rearward portions of the tilt mechanism 408 can dampen and/or counterbalance backward rotation of the seat as a user assumes the recline orientation from a fully seated, forward-leaning or sit/stand orientation.

The rearward portions of the tilt mechanism 408 can include one or more leaf springs 424, initially in an unloaded condition or a slightly preload condition, such as to counterbalance the weight of seating assembly components and/or the user's mass, and a spring contact assembly 426. The spring contact assembly 426 can be positioned along a top side of the one or more leaf springs 424 and can include a roller member 428 to encourage translation along the top side. A location of the spring contact assembly 426 on the top side of the one or more leaf springs 424 can dictate a spring force on the seat and back support, as well as dictate a neutral, unloaded orientation of the seat and back support. Moving the spring contact assembly 426 in a forward direction, for example, along the top side of a leaf spring 424 not only increases the spring force experienced by the seat and back support, but also orients the seat and back support in a more forward orientation. Similarly, for example, moving the spring contact assembly 426 in a rearward direction along the top side of a leaf spring 424 not only decreases the spring force experienced by the seat and back support, but also orients the seat and back support in a more rearward orientation.

The one or more leaf springs 424 can include a stacked arrangement of two or more leafs or can include a single composite leaf. The stacked arrangement can include offset leafs having a similar stiffness along their length. The composite leaf can be made of fiberglass materials, glass reinforced polymers, or thermoplastic materials, for example, and can have a varying or constant stiffness along its length. Optionally, one or more coil or rubber springs can be used in lieu of, or in addition to, the leaf springs 424.

Figure 5:
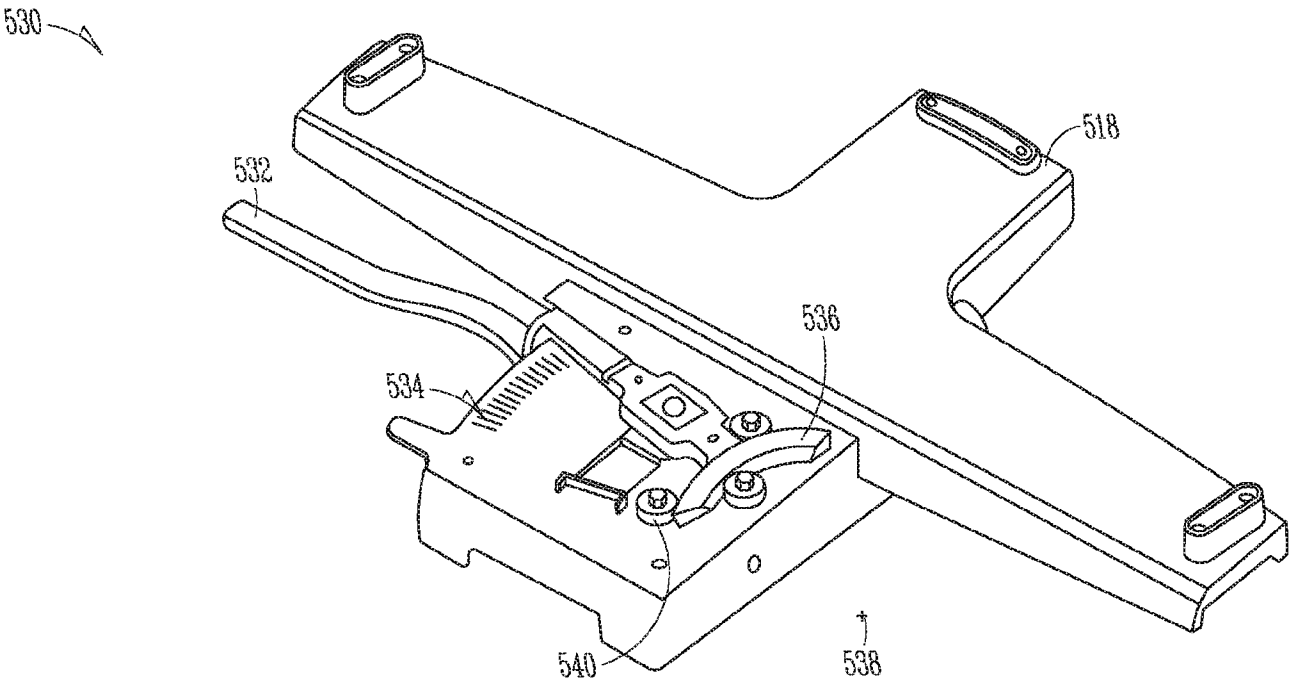
FIG. 5 illustrates an elevated isometric view of an adjuster mechanism for use in a seating assembly, as constructed in accordance with at least one embodiment.

FIG. 5 illustrates an adjuster mechanism 530 that can be coupled to portions of a spring contact assembly to adjust its location along a top side of one or more leaf springs. In this way, a force of the one or more leaf springs acting on a frame component 518 and thus, a seat and back support, during a pivoting or rotating movement can be changed. It has been found that placement of the spring contact assembly on the top side of the one or more leaf springs, rather than below a bottom side, can allow for easier user manipulation. In varying examples, a micro movement of a lever arm 532 included in the adjuster mechanism 530 can result in macro adjustment of the force acting on the frame component 518. Moving the lever arm 532 forward can increase the force acting on the frame component 518 and moving the lever arm 532 rearward can reduce the force.

The lever arm 532 can engage with one or more ratchet teeth 534 of the frame component 518 when a desired location of the spring contact assembly, along the length of the one or more leaf springs, is selected. The one or more ratchet teeth 534 can be configured to engage one or more projections on an underside of the lever arm 532 and can prevent the spring contact assembly from translating down the one or more leaf springs when adjustment is not desired. Lifting of the lever arm 532 a short distance away from the frame component 518 can disengage the ratchet teeth 534 and allow for easy forward or rearward travel, as desired.

The adjuster mechanism 530 can be configured to form a virtual pivot point 538, which is located at a point spaced from a perimeter of the frame component 518. The virtual pivot point 538 can be created using three guide rollers 540 engaged with a pivoting end 536 of the lever arm 532. The pivoting end 536 can include an arc configuration engaged with the three guide rollers 540. The three guide rollers 540 can be used to guide the pivoting end 536 in such a way that a user-engaged end of the lever arm 532 is afforded greater linear travel while minimizing the width and mass of the overall adjuster mechanism 530.

Figure 6:
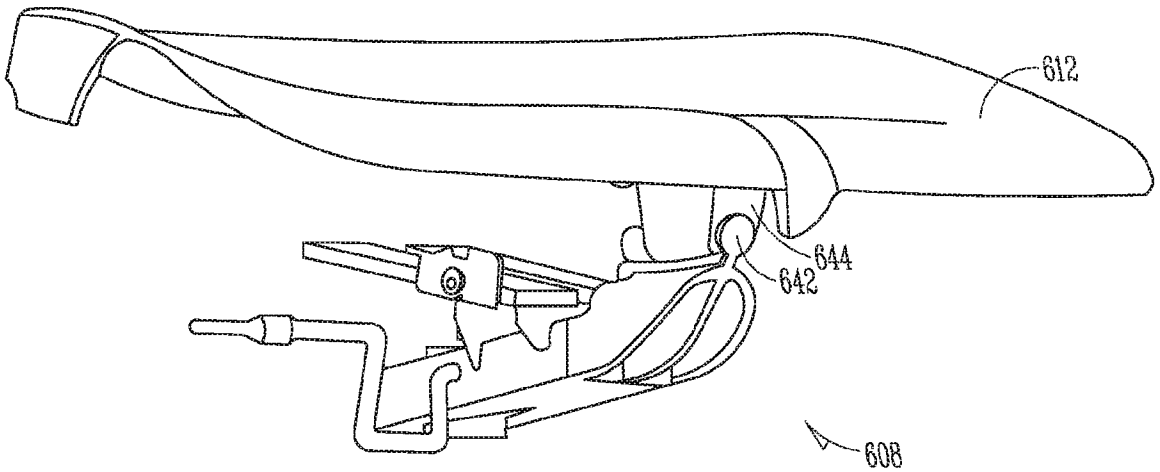
FIG. 6 illustrates an isometric view of frontward portions of a tilt mechanism for use in a seating assembly, including a slide linkage engaged with a front end portion of a seat, as constructed in accordance with at least one embodiment.

FIG. 6 illustrates a frontward portion of a tilt mechanism 608 for use in a seating assembly. The frontward portion of the tilt mechanism 608 can be used in conjunction with the rearward portion of the tilt mechanism 408 described in association with FIG. 4, for example. The frontward portion of the tilt mechanism 608 can include a slide linkage 642 engaged with a front end portion 644 of a flexible seat 612 and oriented perpendicular to a seat width. The slide linkage 642 in conjunction with the rearward portions of the tilt mechanism 408 portions of FIG. 4, for example, can allow for synchronized kinematic motion between the seat 612 and a back support. During a reclining motion, for example, a back portion of the seat 612 cart rotate downward against a spring force of one or more leaf springs and the front end portion 644 of the seat 612 can translate backward along the slide linkage 642 while limiting any vertical rise. During a forward leaning motion, the back portion of the seat 612 can rotate upward with the benefit of the spring force and the front end portion 644 of the seat 612 can translate forward along the slide linkage 642 while a weight of a user's legs on each side of the linkage create a raised pubic arch, at a forward leaning or sit/stand orientation, to help secure the user in the seating assembly. The slide linkage 642, incorporated with the flexible seat 612, can provide the manufacturing advantage of less cost and complexity relative to a 4-bar linkage configuration, for example.

Optionally, as illustrated in FIG. 6, the slide linkage 642 can include a circular, rounded, or other surface that allows the front end portion 644 of the seat 612 to rotate about the linkage's longitudinal axis. In other examples, the slide linkage 642 can include a tongue and groove or other configuration with the seat, which results in the front end portion 644 of the seat 612 being non-rotatable about the linkage's length.

Figure 7:
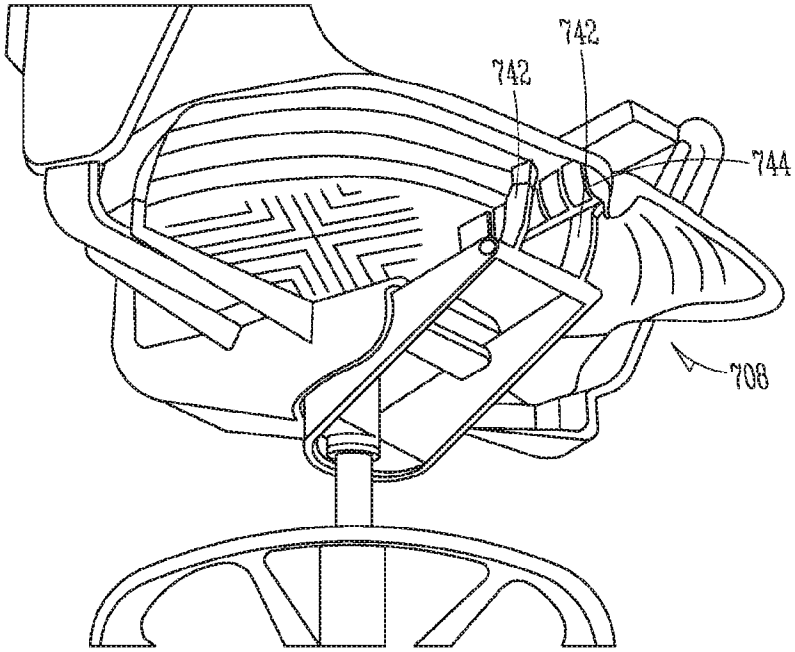
FIG. 7-10 illustrate isometric views of portions of a tilt mechanism for use in a seating assembly, including various mechanisms engageable with a front end portion of a seat, each constructed in accordance with at least one embodiment.
Figure 8:
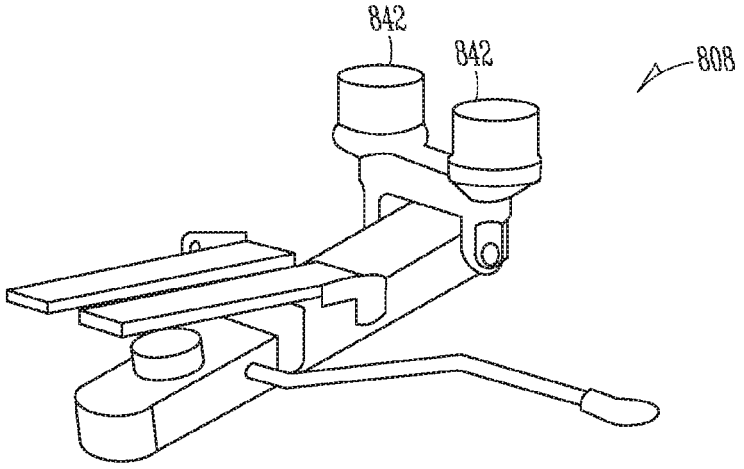
Figure 9:
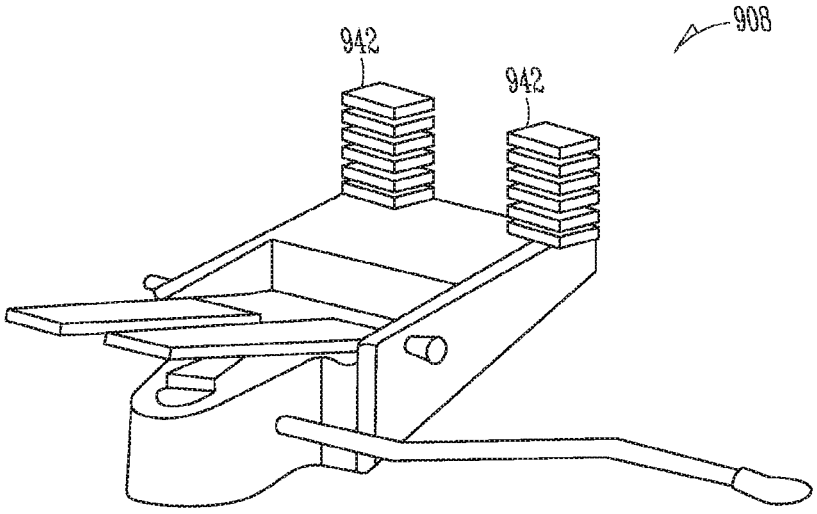
Figure 10:
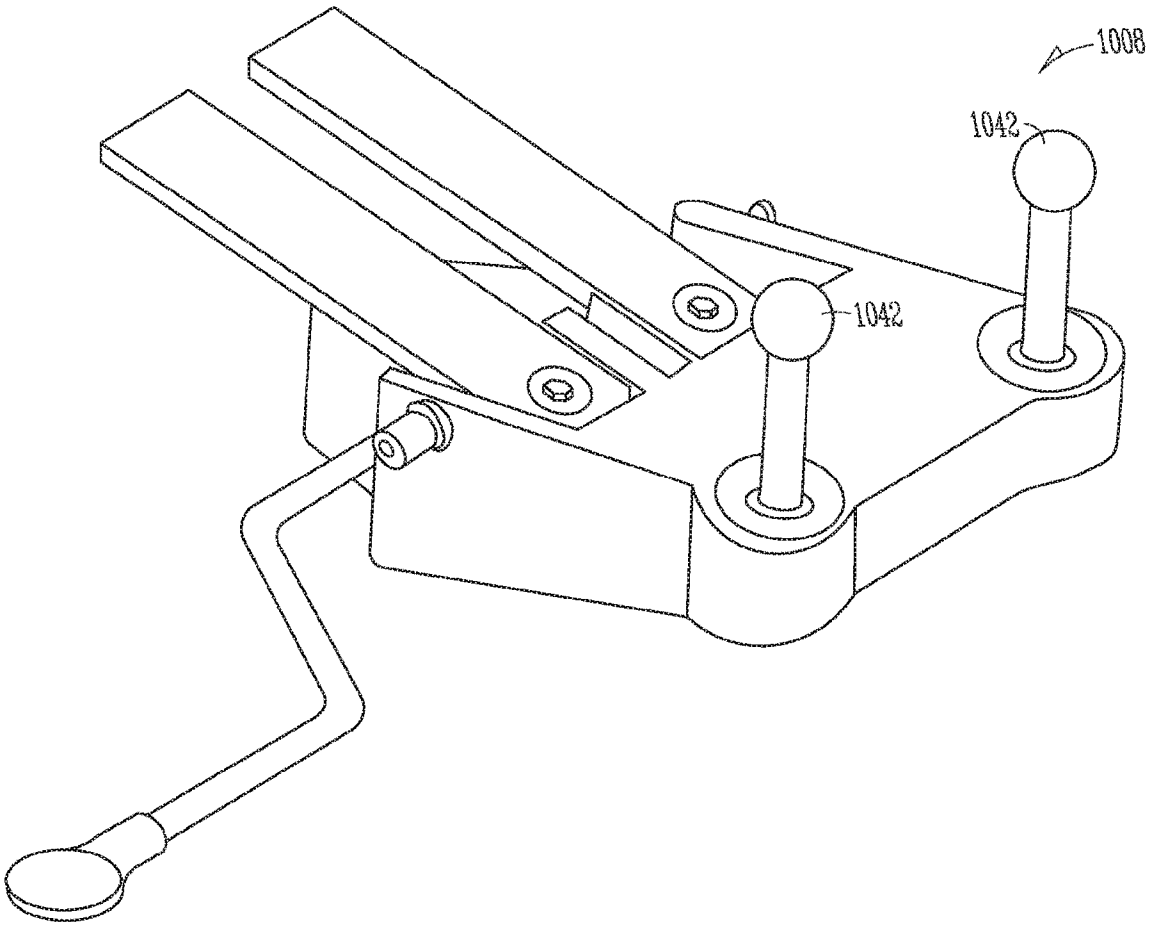

FIGS. 7-10 illustrate alternatives for the frontward portion of the tilt mechanism 608 shown in FIG. 6 and configured to engage a front end portion of a seat. In FIG. 7, a frontward portion of a tilt mechanism 708 including two arm members 742 engaged with a front end portion 744 of a seat 712 is illustrated. In FIGS. 8 and 9, frontward portions of tilt mechanisms 808, 908 including a rubber or other elastomeric mount 842, 942 engaged with a front end portion of a seat are illustrated. In FIG. 10, a frontward portion of a tilt mechanism 1008 including a ball and socket joint 1042 is illustrated.

Each of the varying tilt mechanisms 708, 808, 908, and 1008 can be used with one or more leaf springs, as discussed above. The tilt mechanisms 708, 808, 908, and 1008 cart complement the leaf springs and support the seat during forward and backward motion. It has been found that the combination of a tilt mechanism 708, 808, 908, or 1008 and one or more leaf springs or other biasing members can advantageously provide for a balanced, smooth transition between reclined orientations, neutral (fully seated) orientations, and forward-leaning orientations of a seating assembly. Additionally, the rubber or other elastomeric mounts 842, 942 can allow for small motions of the seat, which can help to reduce fatigue of, and increase comfort to, a user. For example, the rubber or other elastomeric mounts 942 of FIG. 9 include bi-directional flex characteristics.

Figure 11:
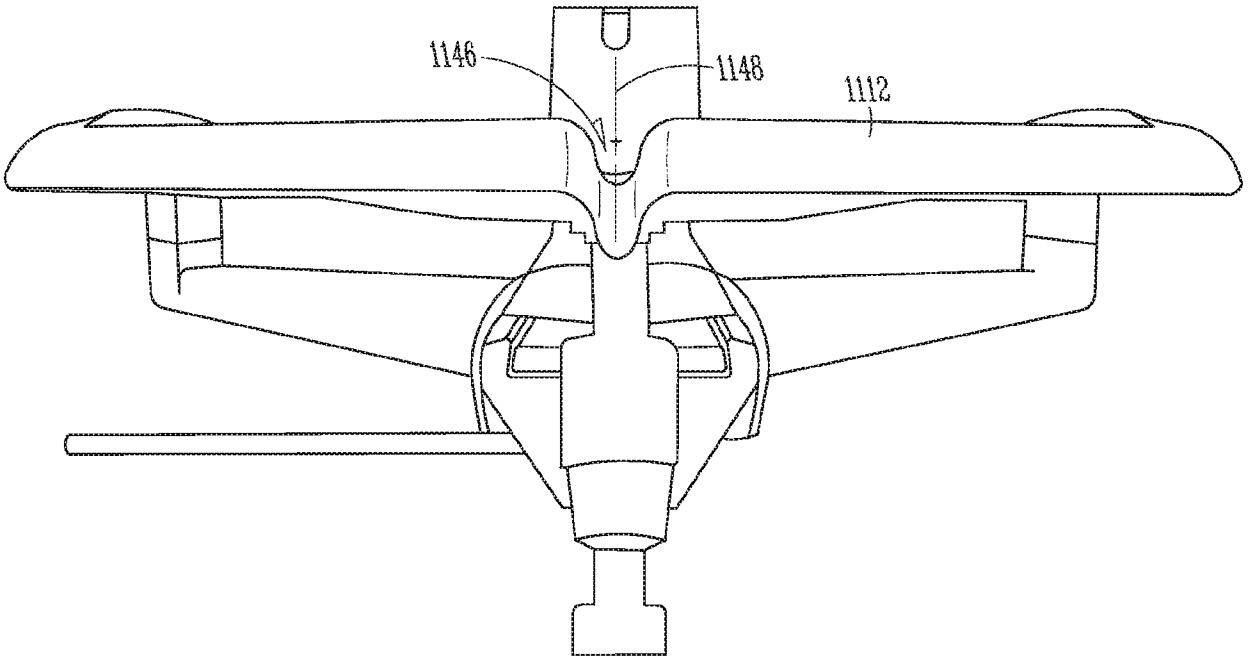
FIG. 11 illustrates a front isometric view of a seat including at least one seat valley positioned along a centerline of the seat, as constructed in accordance with at least one embodiment.
Figure 12:
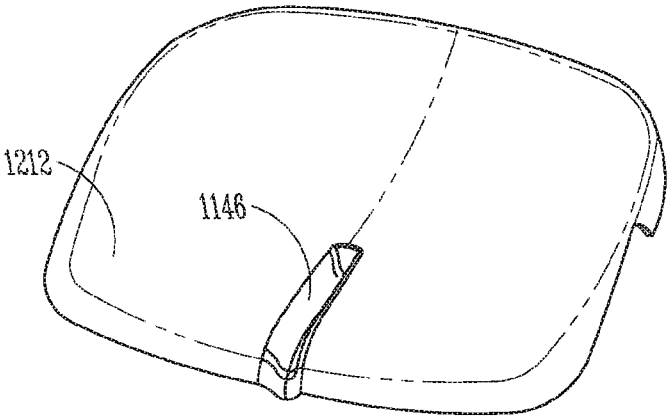
FIGS. 12-13 illustrate top and side views, respectively, of a coupling arrangement between a seat valley and frontward portions of a tilt mechanism, as constructed in accordance with at least one embodiment.
Figure 13:
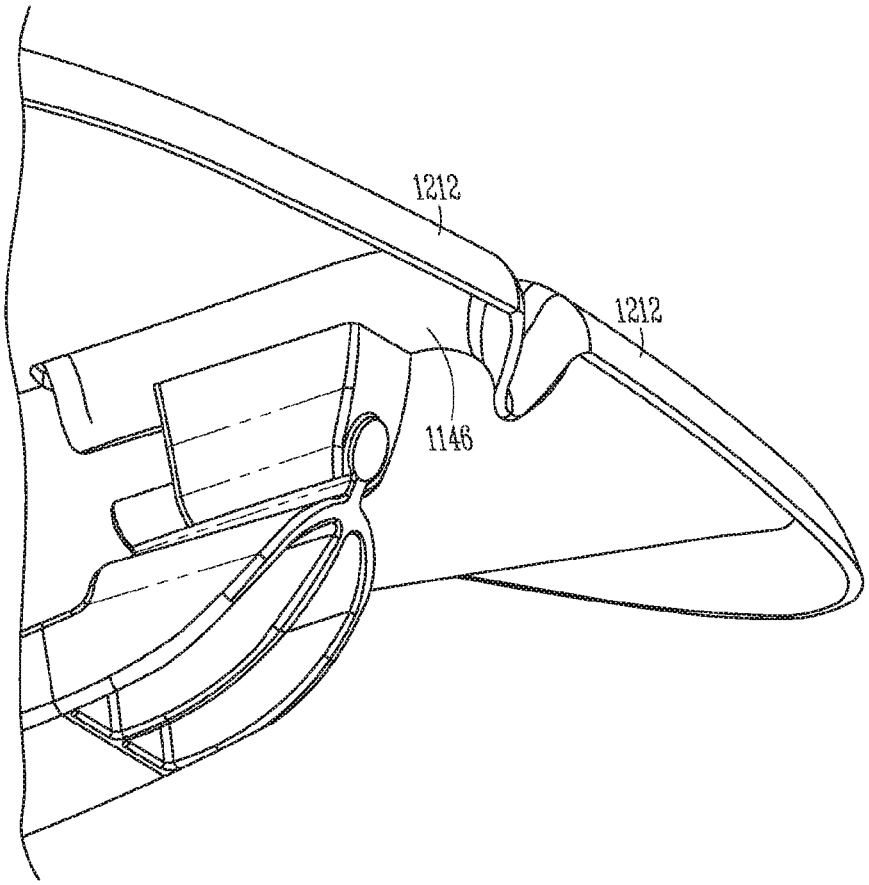

FIG. 11 illustrates a front view of a seat 1112 including at least one seat valley 1146. The at least one seat valley 1146 can be positioned along or near a centerline 1148 of the seat 1112. In some examples, the at least one seat valley 1146 includes a single seat valley positioned along the centerline 1148. In some examples, the at least one seat valley 1146 includes two seat valleys positioned on each side of the centerline 1148. The at least one seat valley 1146 can extend any portion of the distance between a front edge of the seat and a back edge of the seat 1112, providing vertical stiffness to the seat 1112, and can allow side portions to the seat 1112 to deflect in a downward or lateral direction. Additionally, as shown in FIGS. 12 and 13, the at least one seat valley 1146 can provide a structural location to mount to, or engage with, a tilt mechanism associated with a front end portion of the seat 1212.

Figure 14:
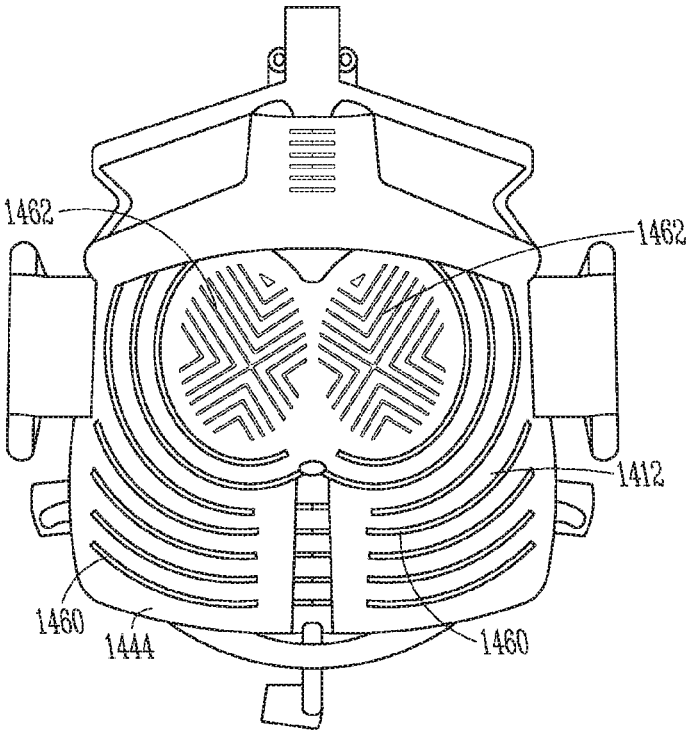
FIG. 14 illustrates a top isometric view of a seat including a plurality of flex voids, as constructed in accordance with at least one embodiment.

FIG. 14 illustrates a top view of a seat 1412 including a plurality of flex voids 1460. The seat 1412 can further include self-adjusting IT regions 1462. The IT regions 1462 can help to lock a user in space on the seat 1412 during movement (e.g., when the user shifts between sit/stand, forward-learning, fully seated, or reclined orientations), inhibiting him/her from sliding forward into a posture causing kyphosis of the spine. Additionally, the IT regions 1462 can provide sitting comfort to the user by adapting to the user's bone structure and/or soft tissue shape in the varying orientations.

The human pelvis has downwardly projecting IT prominences, which are load bearing points of the user in a sitting orientation. The ischial tuberosities can exert as much as 80% of the weight of the user's torso in a confined area. This force concentration or pressure accounts for "hitting bottom" or "bottoming out" of the user on a seat after prolonged sitting. As the user's body is moved to avoid discomfort to these anatomical portions of greatest weight support, the position and subsequent distribution of weight on the spinal column is changed, thus causing posterior movement of the vertebrae in the lumbar region. Such movement can cause stretching of the deltoid muscles of the back, irregular pressure on the vertebral discs, emphasis and increased pressure on the coccyx, or the like. Stretching of the deltoid muscles can reduce the supportive and strength capabilities of these muscles, which can cause further relaxation and posterior curvature of the spine. Such further relaxation and posterior curvature of the spine can cause additional pressure on the anterior side of the discs yielding nervous stress and subsequent reduction of efficiency.

The IT regions 1462 can be adapted to fit under the skeletal seat bone structure of the user. This can provide the advantage of, for example, avoiding reliance on the user's soft tissue as a seating support and reducing any need for the user to adjust orientation to avoid discomfort. The present inventors have found that articulation around the IT regions 1462 can be beneficial for the comfort of the seat 1412. The flexible IT regions 1462 can enhance the seat's conformation to the user's buttocks. These regions 1462 can provide a high level of comfort and allow for "cupping" effects that increase the user's overall body stability within the seating assembly.

The plurality of flex voids 1460 can be molded into or cut from the seat 1412 and can provide for ventilation and seat comfort, such as by being located around potential pressure points. In some examples, the plurality of flex voids 1460 can be positioned about the IT regions 1462 and can extend outward to a location near front and side portions of the seat 1412 to encourage ward or lateral flexion of the chair front. Some of the flex voids 1460 can extend in a direction parallel or substantially parallel to the user's upper leg orientation, when the user is seated. Some of the flex voids 1460 can extend in a direction perpendicular or substantially perpendicular to the user's upper leg orientation, when the user is seated. Collectively, a configuration of the flex voids 1460 can encourage the user into a lumbar support position by directing the IT bones to the IT regions 1462. The front edge of the seat 1412 can also or alternatively include a downward curvature to reduce pressure on the user's upper legs.

Figure 15:
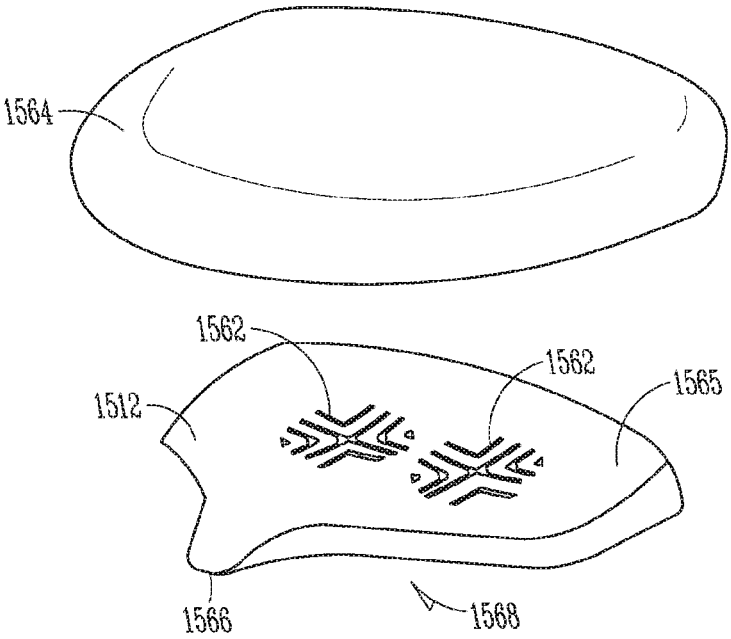
FIG. 15 illustrates an isometric view of a seat, including self-adjusting ischial tuberosities (IT) regions, and a seat cover, as constructed in accordance with at least one embodiment.

FIG. 15 illustrates a seat 1512, including self-adjusting ischial tuberosities (IT) regions 1562, and a seat cover 1564. The seat cover 1564 can be snapped onto or otherwise attached to the seat 1512 and can include a layer of gel or foam. The seat upholstery 1072 can be selected to inhibit sliding of the user on the seat 1512, thereby providing a retaining means in addition to the IT regions 1562. In various examples, the seat upholstery 1072 can include leather, foam, a cotton textile, a urethane skin, or a nylon textile.

As shown in the example of FIG. 15, the seat 1512 can have a relatively large rear buttock support section 1565. The buttock support section 1565 can merge into a central narrow frontal projecting section 1566 through opposed side thigh cavities 1568. The thigh side cavities 1568 can define a concavely curved region to provide comfort to the thighs of a user sitting or leaning on the seat 1512. The upper edge of the seat 1512 can be depressed and rounded for comfort and to prevent hindrance to blood circulation in the legs of the user at the thigh area. Optionally, the top surface of the seat 1512 can include contouring such as elevated sides, a front pommel, or a ridge so-as-to-define leg wells and rear rims to provide further support to the soft tissue of the user's bottom. The seat 15112 can additionally include laterally symmetrical channels, which are generally mirror images of one another and which are formed to cradle the legs of a person seated. The channels together define an intermediate rise or pommel that act to maintain the position of the leg on either side of a central longitudinal axis of the seat.

Figure 18:
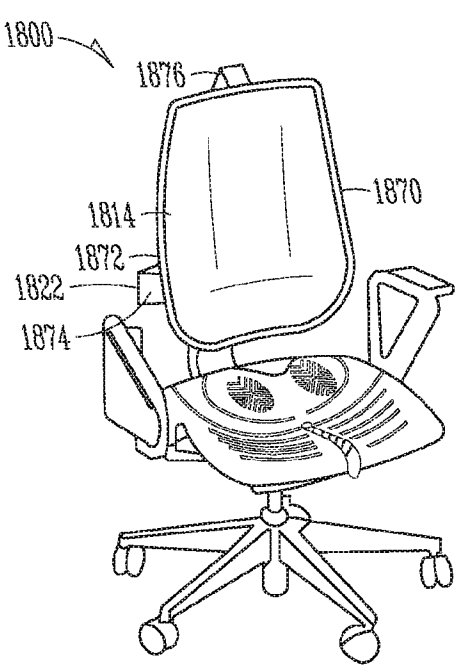
FIGS. 16-18 illustrate isometric views of a seating assembly including varying back supports, each constructed in accordance with at least one embodiment.
Figure 17:
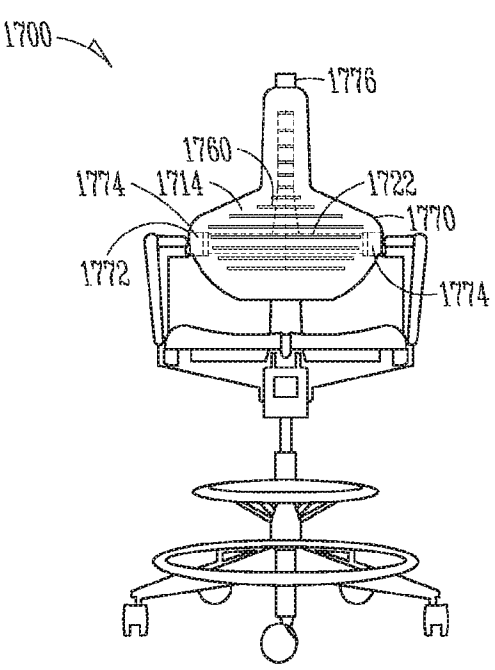
Figure 16:
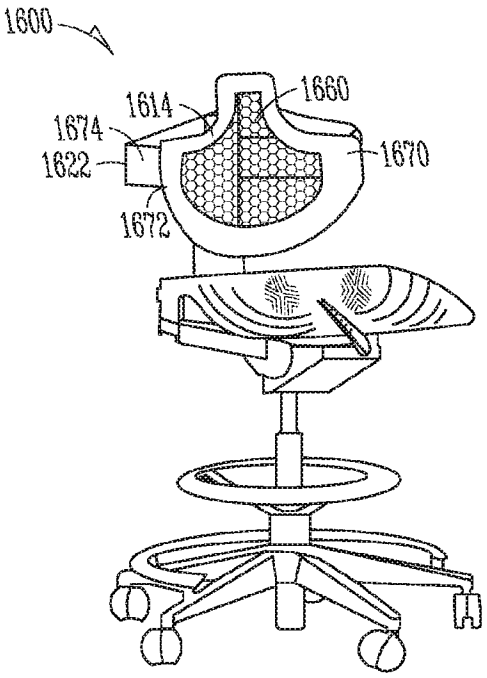

FIGS. 16-18 illustrate seating assemblies 1600, 1700, 1800 including varying back supports 1614, 1714, 1814. Each of the back supports 1614, 1714, 1814 can extend from a left edge portion 1670, 1770, 1870 to a right edge portion 1672, 1772, 1872 and can include a spring member 1622, 1722, 1822. The spring members 1622, 1722, 1822 can be coupled at or near each of the left 1670, 1770, 1870 and right 1672, 1772, 1872 edge portions and can have at least one undulation (or wave-like feature) or arc 1674, 1774, 1874 adjacent each coupling location. The coupling between the spring members 1622, 1722, 1822 and the back support 1614, 1714, 1814 can include an integral mold or weld connection, or can include a separate fastener connection. Stated differently, the back supports 1614, 1714, 1814 and the spring members 1622, 1722, 1822 can collectively comprise a single piece structure or a multiple piece structure. The at least one undulation or arc 1674, 1774, 1874 can provide integrated compression adaptation to a user.

Optionally, the seating assemblies 1600, 1700, 1800 can include a plurality of flex voids 1660, 1760 molded into a single plastic shell, and can include a vertical coupling 1776, 1876 between the spring member 1722, 1822 and the back support 1714, 1814, as shown in FIGS. 17 and 18.

Unlike traditional back supports, which are fixed in space, the present back supports 1614, 1714, 1814 are designed to provide dynamic self-adjustment to a user's back in horizontal and vertical directions through the use of one or more undulations or arcs 1674, 1774, 1874. Undulations or arcs 1674, 1774, 1874, if present, can allow for generally linear translation of the back support 1614, 1714, 1814 toward a top portion of the frame component 1910, and undulations, in particular, can further allow for generally linear translation of the portions of the back support 1614, 1714, 1814 that couple to the spring members 1622, 1722, 1822 during use and can be designed to change or vary the spring force or constant applied by the spring members 1622, 1722, 1822. The undulations can include an S-shape, a Z-shape, or can resemble a corrugated pattern.

Self-adjusting back supports 1614, 1714, 1814 provided by the present seating assemblies 1600, 1700, 1800 can be designed to dynamically maintain contact with the user in "active" (or forward-leaning), neutral (or fully seated), and reclined orientations, and can also limit the spine's ability to assume a kyphotic curvature by maintaining pressure on the sacrum section of the lower back. The amount of force or pressure applied to the user's back by the back supports 1614, 1714, 1814 can be graduated or regulated based on a compression of the back support relative to a top portion of a frame component. Optionally, the spring members 1622, 1722, 1822 can include varying heights and/or thickness and shapes (e.g., they can be tapered between the top portion of the frame component and the back support), such as in a forward-to-backward direction, to provide the graduated or regulated force or pressure applied to the user's back by the back supports 1614, 1714, 1814. By way of example, the amount of force or pressure applied to the user's back by the back support at a forward-leaning position can be less than the amount of force or pressure applied to the user's back by the back support at a neutral or reclined position. In this way, the user's back can be properly supported at various orientations without pushing the user out of the seating assembly when he/she assumes a forward-leaning or more active position.

The present back supports 1614, 1714, 1814 can dynamically support the user's posture while allowing him/her to move side-to-side (e.g., such as in a lateral or horizontal direction), twist, recline, and forward incline, for example. The spring members 1622, 1722, 1822 can be designed with up to about four (4) inches of forward and backward motion. As a result, users with differing body mass can sit in approximately the same location on the seat, such as the locations identified by the IT regions, and they will be accommodated. The self adjustment provided by the back supports 1614, 1714, 1814 can remove the need for distinct seat and back depth adjustment mechanisms, which are typically needed to accommodate different sized users. The back supports 1614, 1714, 1814 can also enable the user to adjust to a comfortable back angle in all seating postures.

Figure 19:
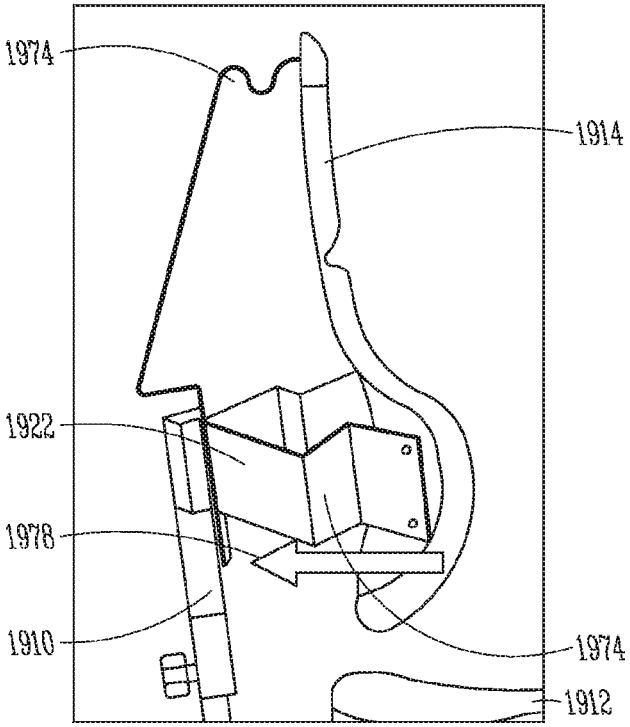
FIG. 19 illustrates an isometric side view of a back support, as constructed in accordance with at least one embodiment.

FIG. 19 illustrates a side isometric side view of a back support 1914 including spring members 1922, each having at least one undulation or arc 1974. As shown in this example, the spring members 1922 include lateral spring component members and a vertical spring component member. The lateral spring component members extend from a top portion of a frame component 1910 to a location at or near each of the left and right edge portion of the back support 1914. The vertical spring component member extends from a top portion of the frame component 1910 to an upper portion of the back support and, as shown for example in FIG. 14, the vertical spring component can be centered on the back support 1914, although it could be otherwise positioned.

The at least one undulation or arc 1974 can be located adjacent coupling locations between the back support 1914 and the spring member 1922 and can provide integrated compression adaptation to a user. As the user sits and leans back, the at least one undulation or arc 1974 can be compressed in a direction 1978 and the user can be properly guided onto a seat 1912. In various examples, the at least one undulation or arc 1974 can provide the back support 1914 with at least one inch, and preferably between approximately 2-4 inches of compression along direction 1978, as well as movement side-to-side and vertical (e.g., the back support can move in all three dimensions and relative to the top portion of the frame component), which in turn, can provide comfort and support to the user. Preferably, this extent of compression along direction 1978 and other movement is allowed by the lateral spring components, and exists even if the vertical spring component member is not present. Compression adaptation of the back support 1914 in conjunction with flexing or pivoting of portions of the seat 1912 can advantageously allow for the dynamic opening of the user's torso to thigh opening.

Optionally, the support frame component 1910 suspending the back support 1914 relative to the seat 1912 can be configured to pivot about its lower end portion, thereby providing a further range of contact between the user and the back support 1914. The frame component 1910 can also or alternatively be height adjustable. As a further option, a manual lever allowing horizontal movement of the back support 1914 can be included for those users preferring an active upright posture.

Figure 20:
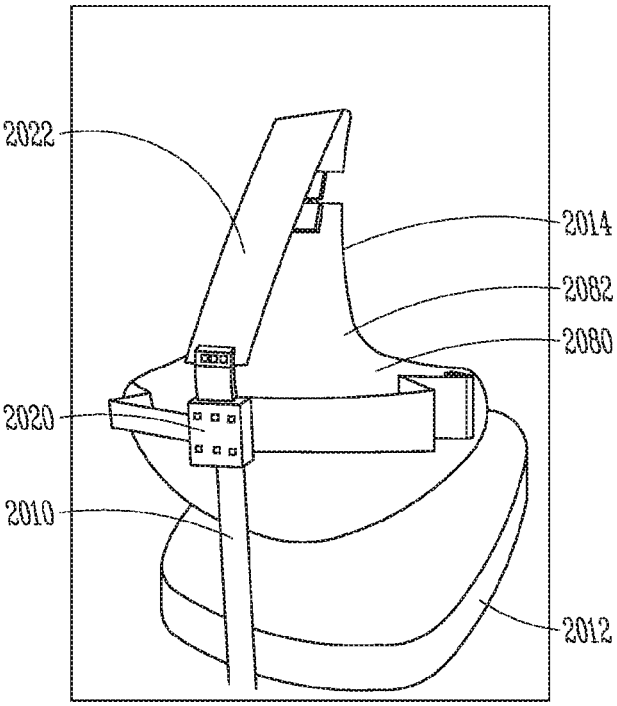
FIG. 20 illustrates an isometric view, from a rearward direction, of a back support, as constructed in accordance with at least one embodiment.

FIG. 20 illustrates an isometric view, from a rearward direction, of a back support 2014. A spring member 2022 between a top portion 2020 of a frame component 2010 and the back support 2014 can be added or removed to allow a user to experience, in a controlled manner, dynamic freedom of movement in varying directions. The spring member 2022 can be coupled to the back support 2014 using, for example, one or more snap-locking clips. In some examples, the spring member 2022 is manufactured from plastic.

The shape of the back support 2014 can provide freedom of arm movement to a user, while supporting the user's spine. In the example shown, the back support 2014 includes an inverted T-shape defining opposed lower side wings 2080 and a narrow intermediate portion 2082. In some examples, the intermediate portion 2082 can include a flex region having a thinner cross-section than adjacent portions of the back support. The narrow intermediate portion can allow the user's arms to move freely and the lower side wings 2080 can wrap around the user's back and help guide him/her on and off the seat 2012.

Figure 21:
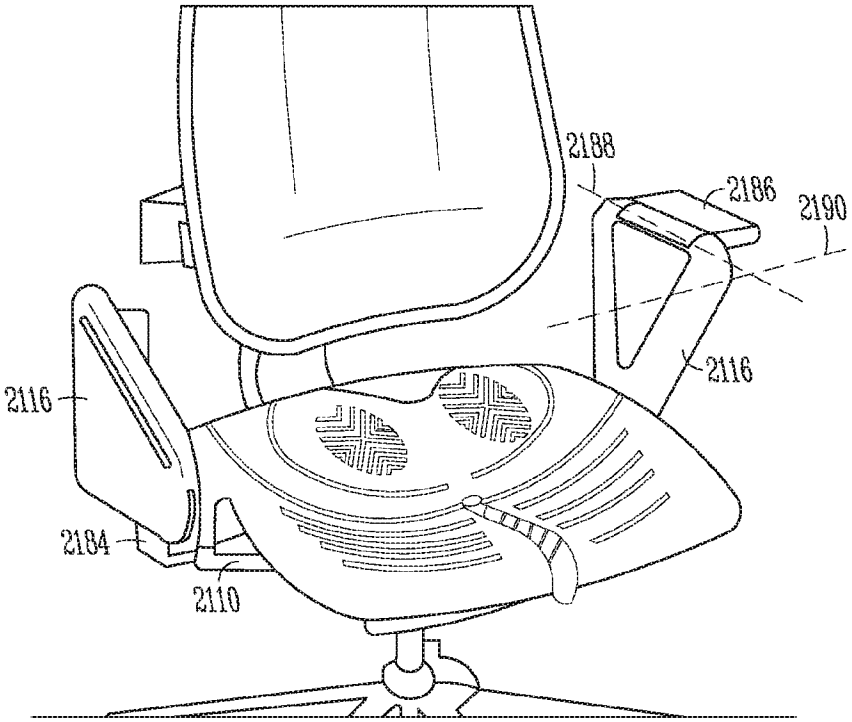
FIGS. 21-22C illustrate isometric views of a seating assembly including an arm rest, each constructed in accordance with at least one embodiment.

FIGS. 21 and 22A-C illustrate configurations of two example arm rests 2116, 2216 for use with a seating assembly. The arm rests 2116, 2216 can be rotatable in and out of position and can be coupled to a support arm 2184, 2284. The support arm 2184, 2284 can be stationary or height adjustable and can be coupled to a frame component 2110, 2210. As shown in the example of FIG. 21, the arm rest 2116 can include a pivotable triangular shape that can be flipped or rotated to a desired configuration. Optionally, the arm rest 2116 can include a stowable arm pad 2186 that can be flipped or rotated in and out of position about an axis 2188 perpendicular to an axis 2190 of rotation of the arm rest 2116.

Figure 22C:
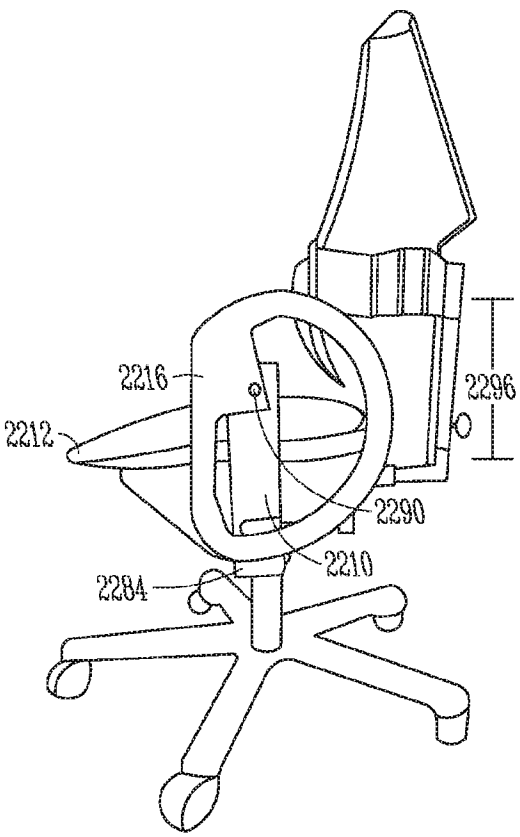
Figure 22B:
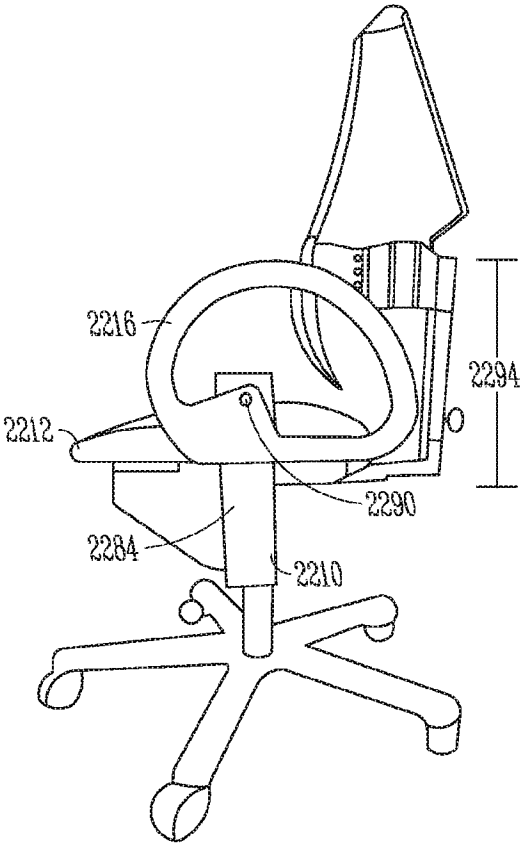
Figure 22A:
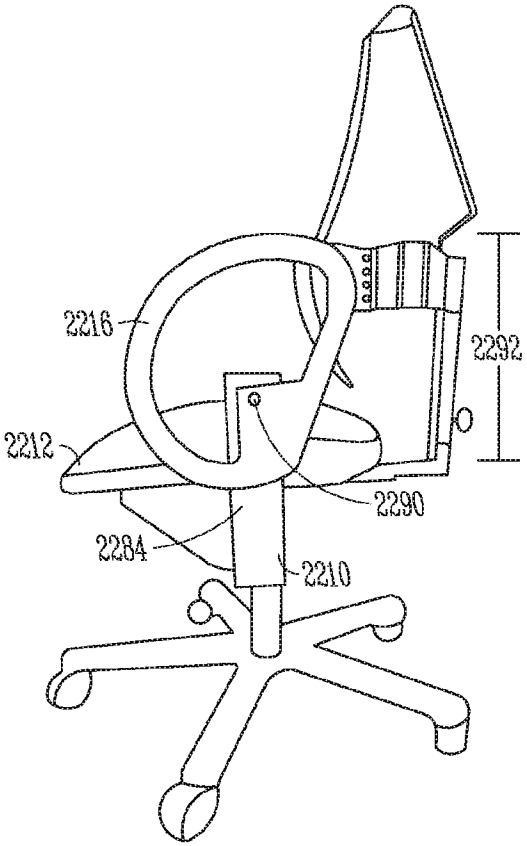

As shown in the example of FIGS. 22A-C, the arm rest 2216 can include a cam shape. Rotation of the cam-shaped arm rest 2216 about an axis 2290 can change an effective supporting position height 2292, 2294, 2296 relative to a seat 2212, without having to adjust a height mechanism embedded in the support arm 2284.

The arm rests 2116, 2216 can be locked in the desired configuration, such as a configuration providing an ergonomically-positioned platform for a user to rest his/her arm. It has been found that the arm rests 2116, 2216 of FIGS. 21 and 22A-C can provide stable arm support to the user in various orientations, including sit/stand, forward-leaning, fully seated (or neutral), and reclining orientations.

Figure 23:
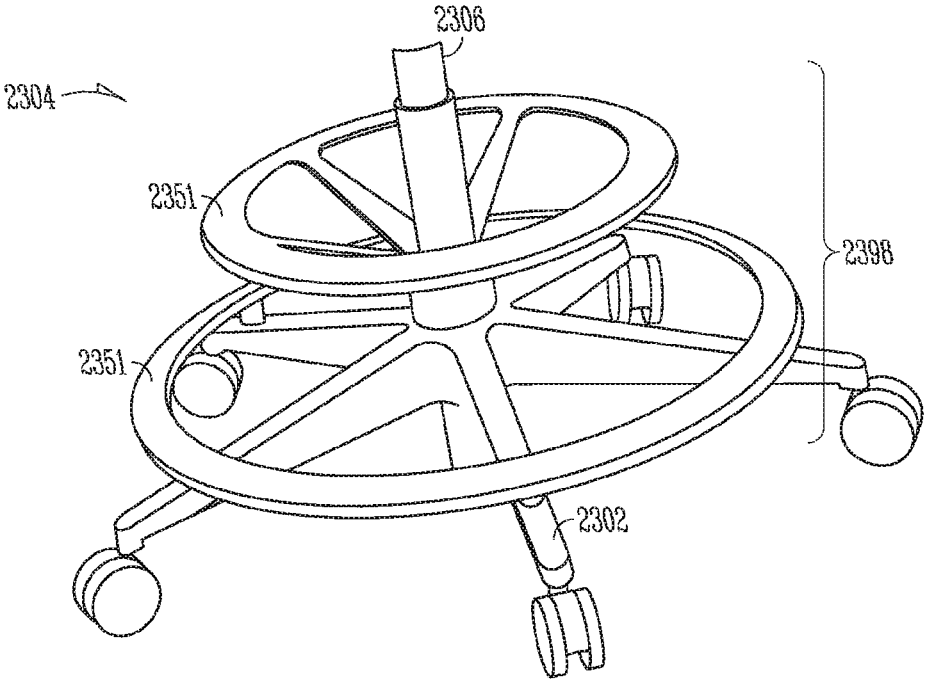
FIGS. 23-25 illustrate isometric view of varying foot supports for use in a seating assembly, each constructed in accordance with at least one embodiment.
Figure 24:
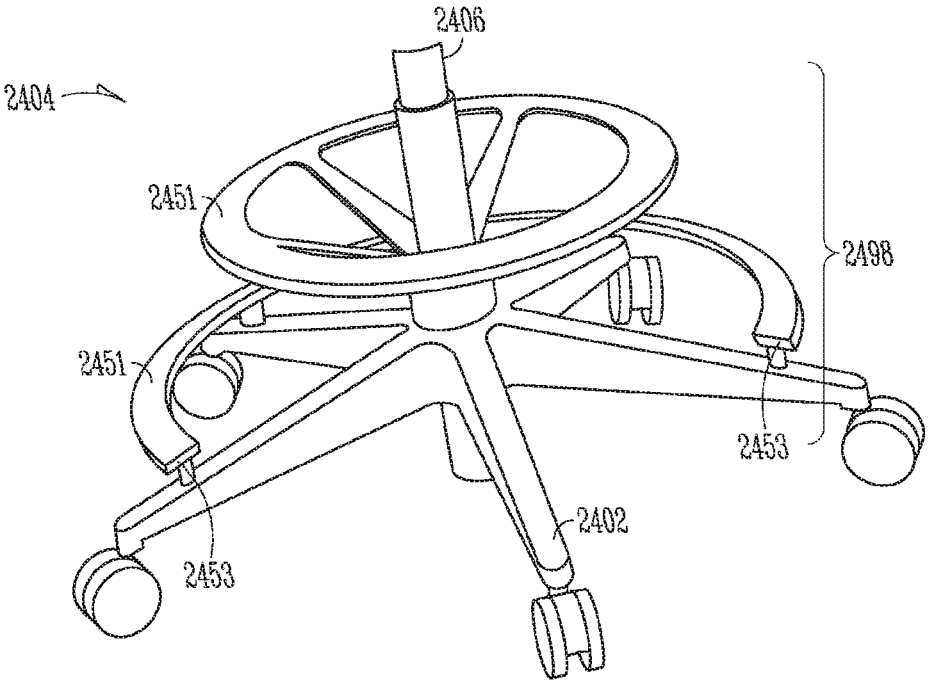
Figure 25:
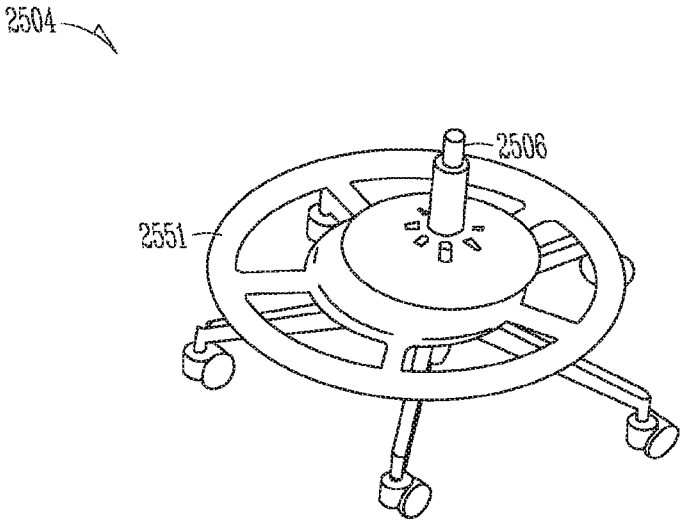

FIGS. 23-25 illustrate example foot supports 2304, 2404, 2504 for use in a seating assembly. As shown in the example of FIGS. 23 and 24, the foot supports 2304, 2404 can include multi-tier platforms or rings 2398, 2498. The multi-tier platforms or rings 2398, 2498 can include two or more platforms or rings 2351, 2451 having reduced diameters, from the bottom to the top, and positioned at spaced apart locations along a pedestal 2306, 2406 vertically extending from a center region of a base 2302, 2402. The multi-tier platforms or rings 2398, 2498 can be designed to maintain a fixed height relative to the base 2302, 2402 to avoid common failures associated with adjustable foot supports (e.g., poorly adjusted at install, rarely adjusted after install, and a lack of secure coupling to a pedestal).

Optionally, the platforms or rings 2351, 2451 can be efficiently manufactured in interlocking segments couplable to the base 2302, 2402. Casting of interlocking segments can result in reduced manufacturing tooling costs relative to the costs associated with casting a complete ring. In the example of FIG. 24, one or more interlocking segments have not been coupled to the base 2402 to create an opening to a support surface, such as for use by a user in a sit/stand orientation. End caps 2453 can provide a finished surface to exposed ends of the interlocking segments.

As shown in the example of FIG. 25, the foot support 2504 can include a horizontally movable platform or ring 2551. The movable platform or ring 2551 can include at least one platform or ring that can be configured to be moved out of the way by a user, as he/she desires. In one example, the center of the platform or ring 2551 is removed so that the outer portions of the platform or ring can be horizontally moved (e.g., about 4 inches) in any direction about a seating assembly's pedestal 2506. The moveable nature of the platform or ring 2551 allows a user to move the platform out of the way when assuming a forward-leaning, sit/stand orientation, thus making space for the user's legs to be placed on a supporting surface. The moveable nature of the platform or ring 2551 can further allow the user to extend the platform or ring under his/her feet when assuming a seated or reclined orientation, allowing the user to achieve a more ergonomically beneficial open knee angle.

Figure 26:
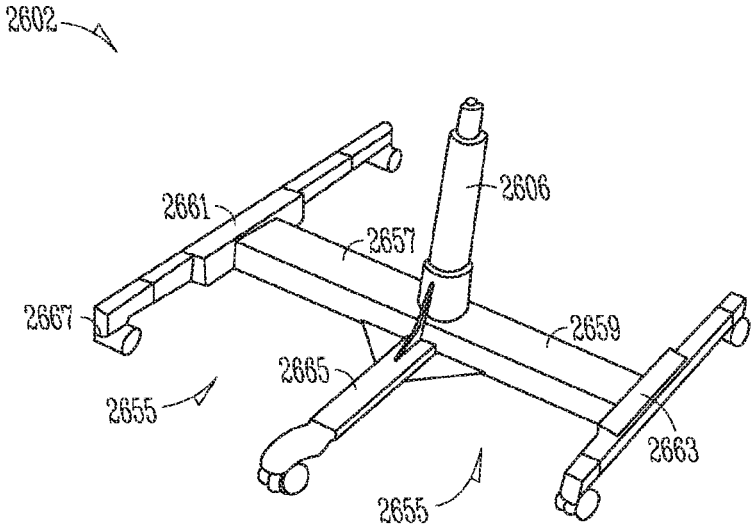
FIG. 26 illustrates an isometric view of a base for use in a seating assembly, as constructed in accordance with at least one embodiment.

FIG. 26 illustrates a W-shaped base 2602, which can provide an alternative to a 5-star base. A pedestal 2606 can vertically extend from a center region of the base 2602 and support a seat and a back support in an elevated position, relative to the base 2602. The base 2602 can include an opening 2655 to a support surface underneath a front edge of the seat to facilitate a user's sit/stand, standing or otherwise upright orientation. The base 2602 can include a first arm member 2657 and a second arm member 2659, where the first arm member 2657 extends from the pedestal 2606 at an angle of about 180 degrees relative to the second arm member 2659. The base 2602 can further include third 2661, fourth 2663, and fifth 2665 arm members. The third arm member 2661 can be coupled at a perpendicular orientation to a distal end of the first arm member 2657, and the fourth arm member 2663 can be similarly coupled to a distal end of the second arm member 2659. The fifth arm member 2665 can extend from the pedestal 2606 at an angle of about 90 degrees relative to the first 2657 and the second 2659 arm members. Optionally, the fifth arm member 2665 can be removed such that the base resembles an H-shape.

The present inventors have found that the W-shaped and the H-shaped bases 2602 can provide favorable feet clearance for a user of the seating assembly and can allow the base to be located close to laboratory work surfaces. Additionally, these base shapes can facilitate easy lateral movement along a counter work surface; are stable allowing users to stand on a foot support assembly with confidence; and result in the user knowing where the base members are located in relation to his/her feet.

Various options can be utilized to lock a position of the base 2602, and thus the associated seating assembly, relative to a work surface. In one example, one or more casters 2667 coupled to an end of the arm members can be manually locked. In another example, one or more casters 2667 coupled to an end of the arm members can be configured to automatically lock under load or at a forward tilt position of a seat or back support. In the example shown, the base 2602 includes five support arm members and five vertically disposed cylindrical sockets. Each of the cylindrical sockets can house a compression spring and a shaft of a wheeled caster. The compression springs can be chosen relative to the weight of the seating assembly such that, when a user is not seated on the seat, the entire seating assembly can be easily moved by the user to any desired position. When the user sits or leans on seat, the user's weight can be greater than the force generated by springs, and the casters can recede into the cylindrical sockets such that a lower edge of the base 2602 becomes the load bearing structure to prevent assembly movement. The option of a locking base to inhibit the tendency of the seating assembly to creep allows a user to be fixed in one location, carrying out one or more tasks for an extended period of time.

Figure 27:
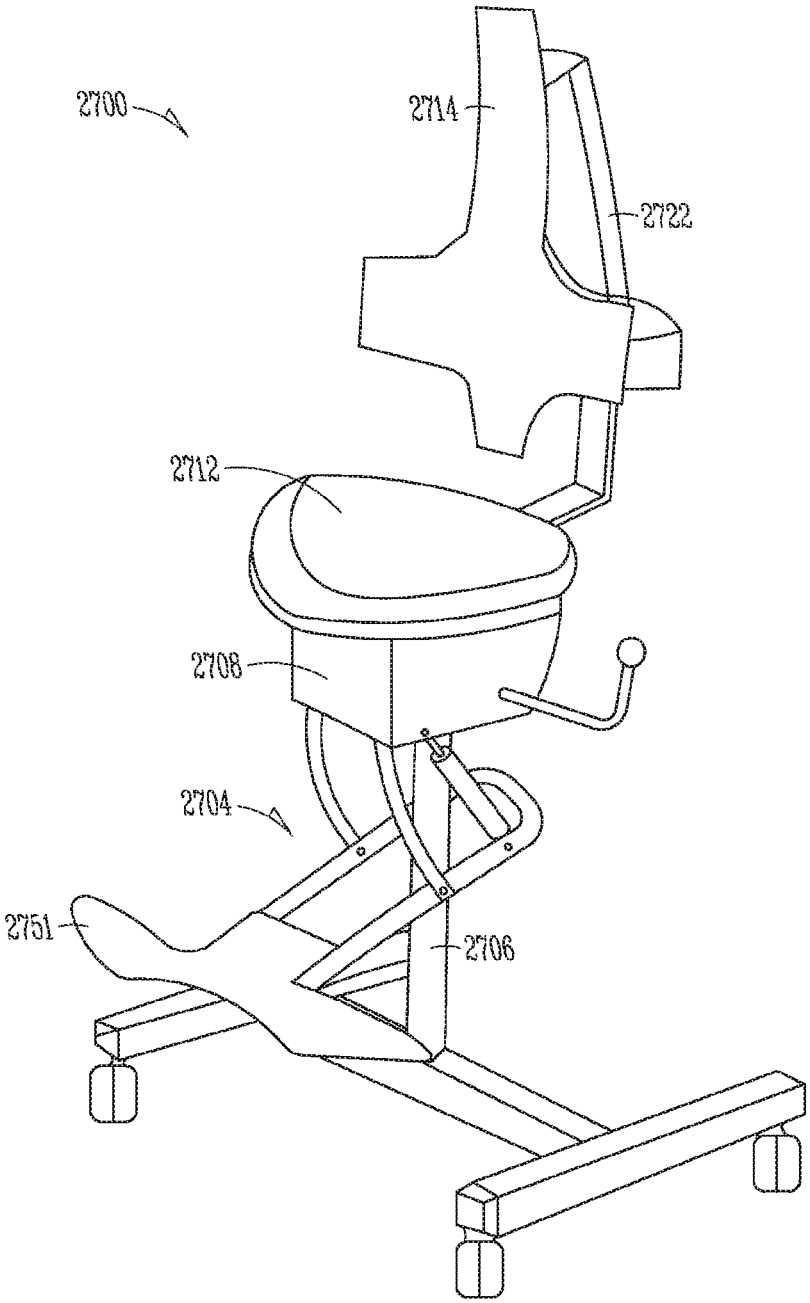
FIG. 27 illustrates an isometric front view of a seating assembly including a deployable foot rest, as constructed in accordance with at least one embodiment.

FIG. 27 illustrates a seating assembly 2700 including, among other things, a deployable foot support 2704. Optionally, a tilt mechanism 2708 can be configured and used to dynamically couple a seat 2712 and a back support 2714. The tilt mechanism 2708 can be attached to, and pivotable about, a top end portion of a pedestal 2706 such that the seat 2712 and the back support 2714 can move between a first orientation, in which a user's torso and upper legs are guided to form an obtuse angular orientation (e.g., such as when the user assumes a sit/stand orientation), and a second orientation, in which the user's torso and upper legs are guided to a more perpendicular orientation (e.g., such as when the user assumes a fully seated or reclined orientation). Through use of the tilt mechanism 2708 and/or a spring member 2722 incorporated into the back support 2714, a portion of the seat 2712 and the back support 2714 can remain in supportive contact with the user at and between the first and second orientations. In some examples, the seat 2712 and the back support 2714 rotate or otherwise move at different rates as the user travels between the first and second orientations, thereby maintaining proper support to the user.

The deployable foot support 2704 allows users of differing builds and heights, and users using high desk platforms, to position their seat 2712 at an appropriate position for their upper body, while providing adequate support for their feet. The deployable foot support 2704 can further allow independent adjustability of the position of a platform 2751 in relation to the seat 2712 to accommodate proper lumbar orientation during various tasks. Further yet, the deployable foot support 2704 can be configured to be efficiently retracted and stored out of the way of the user for easy foot access to the floor.

Figure 28:
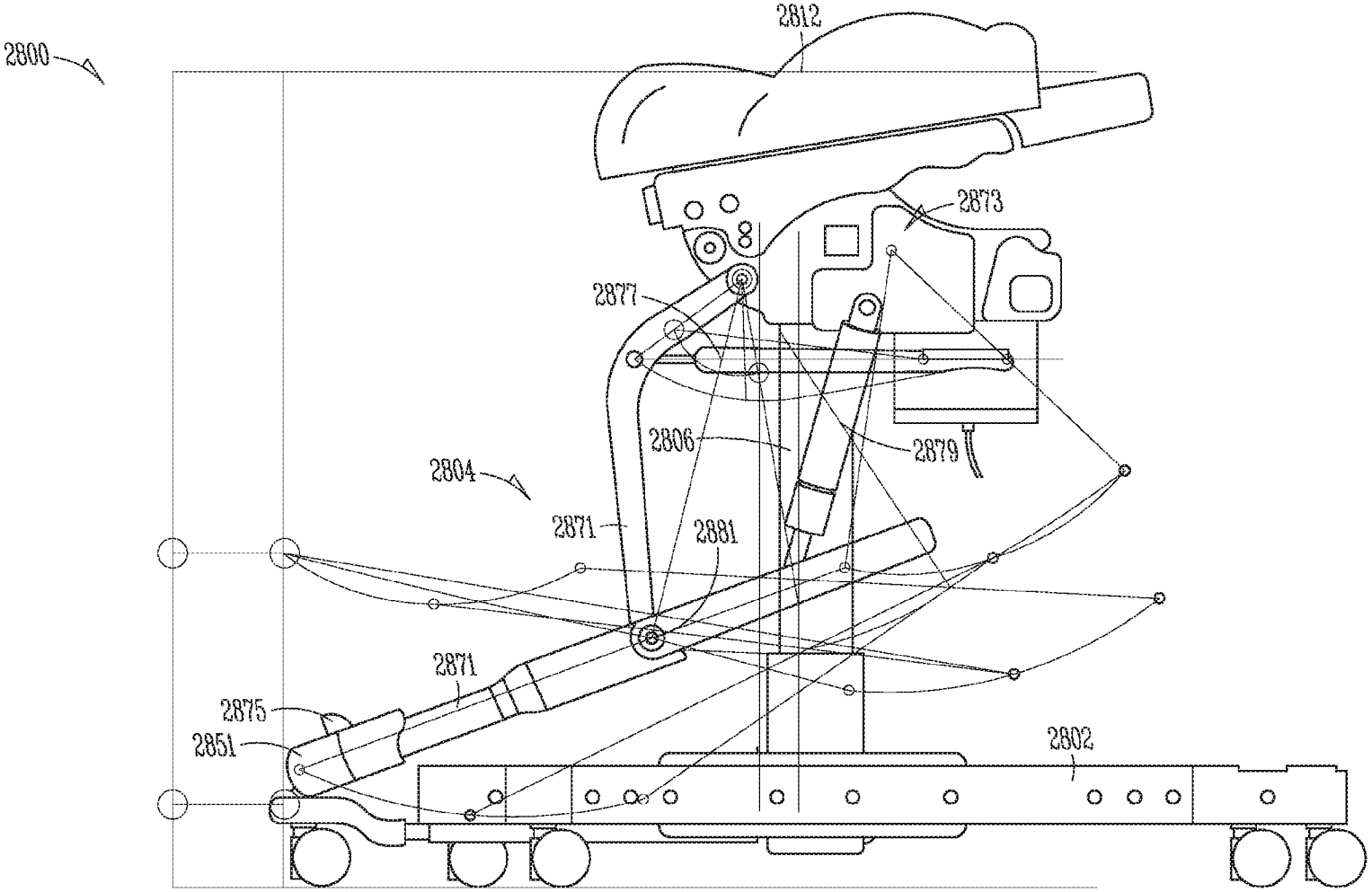
FIG. 28 illustrated an isometric view of a seating assembly without a back support and including a deployable foot rest, as constructed in accordance with at least one embodiment.

FIG. 28 illustrates a seating assembly 2800 including a deployable foot support 2804 and without a back support. The backless seating assembly 2800 can be configured to support at least a portion of the weight of a user in a sit/stand orientation as well as a sitting orientation. The seating assembly 2800 can include a seat 2812, a pedestal 2806, a base 2802, and the deployable foot support 2804. The pedestal 2806 supports the seat 2812 in an elevated position relative to the base 2802. The seat 2812 can include a lockable forward tilt prior to the user fully sitting on the seat; thereby partially supporting the user's weight in the sit/stand orientation. The deployable foot support 2804 includes a platform 2851 and at least one support arm 2871. A first end of the at least one support arm 2871 can be attached to a bracket assembly 2873 and a second end of the support arm 2871 can be coupled to the platform 2851. The at least one support arm 2871 can moveably suspend the platform 2851 relative to the attachment bracket assembly 2873 for curvilinear translation movement in relation to the seat 2812.

One or more foot-activated actuation mechanisms 2875 can be used to trigger a first biasing member 2877 or a second biasing member 2879. The first biasing member 2877 can move the platform 2851 between the extended position shown and a retracted position. The second biasing member 2879 can provide for height adjustment of the platform 2851. Advantageously, foot-activated control of foot support assembly deployment or height adjustment can provide a user-friendly feature and allow for more compact seating assembly designs. The range of travel of the biasing members (e.g., gas springs) can act to limit motion of the platform 2851 between the retracted and extended positions, as well as the vertical movement of the platform 2851. In the example shown, the foot support platform 2851 can include a hinge 2881 so that the platform rides upward if and when it contacts the base 2802.

CLOSING NOTES

Neither a standing nor a sitting position is particularly comfortable unless a user (e.g., worker or student) is provided with proper support that can be adjusted, configured, or otherwise adapted to his/her needs. Proper support is particularly useful where the user assumes a forward-leaning orientation to perform a task.

The present seating assemblies and methods provide innovative features that can ergonomically support a user's body at various orientations, including forward-leaning orientations. The present seating assemblies and methods can provide long-term comfort, stability, and support to a user during completion of various active tasks, can be realigned to accommodate different working or seating orientations, and can be conveniently relocated from a first position to a second position. The interaction of the seat's tilt biasing, IT pockets and flex voids, the back support's spring member and flex voids, and/or a tilt mechanism in operable engagement with the seat and back support can provide a high degree of support to a user's body during micro-motions, twisting, rocking, and flexing.

The above Detailed Description includes references to the accompanying drawings, which form a part of the Detailed Description. The drawings show, by way of illustration, specific embodiments in which the present seating assemblies and methods can be practiced. These embodiments are also referred to herein as "examples."

The above Detailed Description is intended to be illustrative, and not restrictive. The above-described examples (or one or more elements or components thereof) can be used in combination with each other. For example, a first element or component (e.g., a seat) of any figure can be used in combination with a second element or component (e.g., a back support) of a different figure. The elements and components of each figure can be used with elements and components of any other figure to allow assembly of a desired seating assembly. Other embodiments can be used, such as by one of ordinary skill in the art upon reviewing the above description. Also, various features or elements can be grouped together to streamline the disclosure. This should not be interpreted as intending that an unclaimed disclosed feature is essential to any claim. Rather, inventive subject matter can lie in less than all features of a particular disclosed embodiment. Thus, the following claims are hereby incorporated into the Detailed Description, with each claim standing on its own as a separate embodiment. The scope of the invention should be determined with reference to the appended claims, along with the full scope of equivalents to which such claims are entitled.

In the event of inconsistent usages between this document and any document so incorporated by reference, the usage in this document controls.

In this document, the terms "a" or "an" are used to include one or more than one, independent of any other instances or usages of "at least one" or "one or more." The term "or" is used to refer to a nonexclusive or, such that "A or B" includes "A but not B," "B but not A," and "A and B," unless otherwise indicated. The terms "about" and "approximately" are used to refer to an amount that is nearly, almost, or in the vicinity of being equal to a stated amount. The terms "right," "left," "top," "bottom," "underside," "upward," "downward," "rearward," "forward," "backward," "front," and "rear" (or similar designate directions in the drawings to which reference is made. The hypothetical "user" is a potential user of the seat assemblies and can include small-sized individuals, medium-sized individuals, and large-sized individuals, for example. Furthermore, with respect to elements that are referred to herein as coupled, connected, engaged, in communication, etc., there are numerous ways that this coupling, connecting, engaging, communication, etc. can be implemented. For example, common connectors or fasteners, such as screws, bolts, rivets, pins, or studs, can be used, or the elements can be molded as an integral unit without requiring separate fasteners. The numerous ways of coupling, connecting engaging, or otherwise communicating among the elements with respect to embodiments of the invention arc either known or will be apparent to one of ordinary skill in the art in light of the present disclosure.

In the appended claims, the terms "including" and "in which" are used as the plain-English equivalents of the respective terms "comprising" and "wherein." The terms "including" and "comprising" are open-ended, that is, an assembly or method that includes elements in addition to those listed after such a term in a claim are still deemed to fall within the scope of that claim. Moreover, in the following claims, the terms "first," "second," and "third," etc. are used merely as labels, and are not intended to impose numerical requirements on their objects.

The Abstract is provided to allow the reader to quickly ascertain the nature of the technical disclosure. It is submitted with the understanding that it will not be used to interpret or limit the scope or meaning of the claims.

What is claimed is:

1. A seating assembly comprising:

a seat including a cupped IT region;

a frame component coupled with the seat;

a back support assembly coupled with the frame component and separated from the seat, the back support assembly includes:

a back support having a peripheral edge portion surrounding an inner portion, and at least first and second spring members proximate opposed portions of the peripheral edge portion, the first and second springs extending from the opposed portions to the frame component, and wherein the back support is isolated from the frame component and the seat by the first and second spring members, the back support is independently movable relative to the frame component through independent deflection of one or more of the first and second spring members, and the seat is isolated from movement of the back support; and wherein the first and second spring members are configured to self-adjust the position of the back support relative to both the frame component and the cupped IT region according to a plurality of different size users seated at the cupped IT region.

2. The seating assembly of claim 1, wherein the first and second spring members include at least three configurations including relaxed, first user and second user configurations:

in the relaxed configuration the first and second springs position the back support at a relaxed location relative to the frame component and the cupped IT region, in the first user configuration the first and second springs position the back support at a first location relative to the frame component and the cupped IT region, the first location depressed relative to the relaxed location according to a first mass of the first user, and in the second user configuration the first and second springs position the back support at a second location relative to the frame component and the cupped IT region, the second location depressed relative to the first location according to a second mass of the first user.

3. The seating assembly of claim 2, wherein the first location of the back support is spaced rearward from the relaxed location, and wherein the second location of the back support is spaced further rearward from the relaxed location than the first location.

4. The seating assembly of claim 1, wherein the first and second spring members include members joined at an angle with an adjustable space between the members.

5. The seating assembly of claim 4, wherein with the back support in a depressed configuration relative to a relaxed configuration the adjustable space between the members is less than the adjustable space with in the relaxed configuration.

6. The seating assembly of claim 1, wherein the opposed portions of the peripheral edge portion include respective left and right portions of the peripheral edge portion, and the first and second spring members are coupled with the back support proximate the left and right portions, respectively.

7. The seating assembly of claim 1, wherein the back support includes at least one flex region configured to promote flexion of the back support across a back of the user.

8. The seating assembly of claim 7, wherein the flex region includes one or more flex voids.

9. A seating assembly comprising:

a seat;

a frame component coupled with the seat, the frame component extends from the seat; and a back support assembly coupled with the frame component, the back support assembly includes:

a back support having a peripheral edge portion and an inner portion, the peripheral edge portion having an upper portion and a lower portion, and the peripheral edge portion extends around the inner portion, first and second spring members proximate opposed portions of the peripheral edge portion between the upper and lower portions, the first and second spring members extend from the opposed portions of the peripheral edge portion, respectively, to the frame component, and at least the first and second spring members isolate the seat from movement of the back support, and wherein the back support is movable relative to the frame component through independent deflection of one or more of the first or second spring members, and each of the upper, lower and opposed portions are configured for independent motion according to the independent deflection.

10. The seating assembly of claim 9, wherein the seat includes a cupped IT portion, and the first, second and third spring members are configured to self-adjust the position of the back support relative to both the frame component and the cupped IT region according to a plurality of different size users seated at the cupped IT region.

11. The seating assembly of claim 10, wherein the first or second spring members include at least three configurations including relaxed, first user and second user configurations:

in the relaxed configuration the first or second spring members position the back support at a relaxed location relative to the frame component and the cupped IT region, in the first user configuration the first or second spring members position the back support at a first location relative to the frame component and the cupped IT region, the first location depressed relative to the relaxed location according to a first mass of the first user, and in the second user configuration the first or second spring members position the back support at a second location relative to the frame component and the cupped IT region, the second location depressed relative to the first location according to a second mass of the first user.

12. The seating assembly of claim 11, wherein the first location of the back support is spaced rearward from the relaxed location, and wherein the second location of the back support is spaced further rearward from the relaxed location than the first location.

13. The seating assembly of claim 9, wherein the first or second spring members include members joined at an angle with an adjustable space between the members.

14. The seating assembly of claim 13, wherein the opposed portions of the peripheral edge portion include respective left and right portions of the peripheral edge, and the first and second spring members are coupled with the back support proximate the left and right edge portions.

15. A seating assembly comprising:

a seat;

a frame component coupled with the seat;

a back support assembly coupled with the frame component, the back support assembly includes:

a back support having a peripheral portion and an inner portion, the peripheral portion remote from the inner portion, at least first and second spring members coupled with the back support proximate to the peripheral portion, and the first and second spring members extend from proximate the peripheral portion to the frame component, and the back support is isolated from the seat and the frame component by the first and second spring members, and wherein the back support is movable relative to the frame component through independent deflection of one or more of the first and second spring members and the seat is isolated from movement of the back support.

16. The seating assembly of claim 15, wherein the peripheral portion includes first and second opposed portions remote from the inner portion, and the first spring member extends from the first opposed portion and the second spring member extends from the second opposed portion, the second opposed portion opposed to the first opposed portion.

17. The seating assembly of claim 16, wherein the first and second opposed portions include left and right opposed portions, respectively.

18. The seating assembly of claim 16, wherein the first spring member is coupled proximate the first opposed portion, and the second spring member is coupled proximate the second opposed portion.

19. The seating assembly of claim 15, wherein the first and second spring members include members joined at an angle with an adjustable space between the members.

20. The seating assembly of claim 1, wherein the peripheral edge portion includes a lower portion and an upper portion, and the first and second spring members extend from the opposed portions between the upper and lower portions, and wherein the upper and lower portions of the back support are configured to translate in opposed directions relative to the first and second spring members.

21. The seating assembly of claim 20, wherein the first and second spring members are proximate a lumbar of the user, and the lower portion of the back support is proximate a sacrum of the user.

22. The seating assembly of claim 9, wherein the back support is isolated from the frame component and the seat by at least the first, second and third spring members, and the back support is movable in isolation relative to the frame component through deflection of one or more of the first, second or third spring members.

23. The seating assembly of claim 9, wherein the first and second spring members are proximate a lumbar of the user, and the lower portion of the back support is proximate a sacrum of the user.

24. The seating assembly of claim 15, wherein the back support is movable in isolation relative to the frame component and the seat through independent deflection of one or more of the first and second spring members.

25. The seating assembly of claim 15, wherein the back support includes upper and lower portions and the peripheral portion includes opposed portions between the upper and lower portions, and each of the upper, lower and opposed portions are configured for independent motion according to the independent deflection of one or more of the first and second spring members.

26. The seating assembly of claim 9, wherein the back support assembly includes a third spring member extending between the frame component and the upper portion of the back support, the third spring member is above the first and second spring members.

* * * * *